US010731831B2

(12) United States Patent
Chang et al.

(10) Patent No.: US 10,731,831 B2
(45) Date of Patent: Aug. 4, 2020

(54) CLIP LIGHTS AND RELATED SYSTEMS

(71) Applicant: Gemmy Industries Corp., Coppell, TX (US)

(72) Inventors: Lio Yenwei Chang, Lewisville, TX (US); Cheng-Chun Zhang, Shenzhen (CN)

(73) Assignee: Gemmy Industries Corp., Coppell, TX (US)

( * ) Notice: Subject to any disclaimer, the term of this patent is extended or adjusted under 35 U.S.C. 154(b) by 280 days.

(21) Appl. No.: 15/599,165

(22) Filed: May 18, 2017

(65) Prior Publication Data

US 2018/0320868 A1 Nov. 8, 2018

Related U.S. Application Data

(63) Continuation-in-part of application No. 15/589,507, filed on May 8, 2017, now abandoned.

(51) Int. Cl.
*F21V 21/088* (2006.01)
*F21V 23/00* (2015.01)
(Continued)

(52) U.S. Cl.
CPC ..... *F21V 21/088* (2013.01); *F21S 4/10* (2016.01); *F21V 3/00* (2013.01); *F21V 23/001* (2013.01);
(Continued)

(58) Field of Classification Search
CPC ..... F21V 21/088; F21V 23/00; F21S 4/10
See application file for complete search history.

(56) References Cited

U.S. PATENT DOCUMENTS 1,533,209 A 4/1925 Radu
2,599,303 A 6/1952 Ward
(Continued)

FOREIGN PATENT DOCUMENTS

CA 158920 7/2015
CN 201428936 Y 3/2010
(Continued)

OTHER PUBLICATIONS

Bruce, James, "How to Control Your Custom RGB Lighting From a Harmony Remote," published Jun. 2, 2013, obtained Dec. 1, 2016 from: <http://www.makeuseof.com/tag/how-to-control-your-custom-rgb-lighting-from-a-harmony-remote/>, 8 pgs.
(Continued)

*Primary Examiner* — Daniel I Walsh
(74) *Attorney, Agent, or Firm* — Venable LLP; Michele V. Frank

(57) ABSTRACT

A clip light can include a clip having a first clamp member and a second clamp member that opposes the first clamp member, wherein the first clamp member and the second clamp member are elastically biased towards one another; a light emitting diode located on the first clamp member; and a light unit cover that encloses the light emitting diode. A lighting system can include: a plurality of clip lights arranged into a light string by wires; a power adapter that transmits power to the plurality of clip lights through the wires and a set of wires that connects the plurality of clip lights to the power adapter.

13 Claims, 32 Drawing Sheets

(51) Int. Cl.

| | |
|---|---|
| ***F21S 4/10*** | (2016.01) |
| ***F21V 3/00*** | (2015.01) |
| ***H05B 47/19*** | (2020.01) |
| *F21V 31/00* | (2006.01) |
| *F21Y 115/10* | (2016.01) |
| *F21Y 113/13* | (2016.01) |
| *F21W 131/10* | (2006.01) |
| *F21W 121/00* | (2006.01) |

(52) U.S. Cl.

CPC ..... *H05B 47/19* (2020.01); *F21V 31/005* (2013.01); *F21W 2121/004* (2013.01); *F21W 2121/006* (2013.01); *F21W 2131/1005* (2013.01); *F21Y 2113/13* (2016.08); *F21Y 2115/10* (2016.08)

(56) References Cited

U.S. PATENT DOCUMENTS 3,189,310 A 6/1965 Trueson
3,386,070 A 5/1968 Jansson et al.
3,861,632 A * 1/1975 Siilats ..... F21V 19/0005 248/224.7
4,107,764 A 8/1978 Riley
4,425,605 A * 1/1984 Cheng ..... F21S 4/10 315/185 S
4,877,209 A 10/1989 Gary
4,962,687 A 10/1990 Belliveau et al.
5,044,058 A 9/1991 Voss
5,084,803 A 1/1992 Lan
5,142,461 A 8/1992 Nugent
D338,976 S * 8/1993 Miley, Jr. ..... D26/42
5,238,425 A 8/1993 Kliewer
5,324,224 A 6/1994 Anderson et al.
D348,743 S 7/1994 Leen et al.
5,355,288 A 10/1994 Maddock
5,400,234 A * 3/1995 Yu ..... F21V 21/088 362/396
5,497,307 A * 3/1996 Bae ..... A44C 15/0015 362/104
5,531,411 A * 7/1996 Adams ..... A47G 33/105 248/309.1
5,555,658 A 9/1996 Yu
5,575,446 A 11/1996 Swenson et al.
5,581,956 A 12/1996 Fennessy et al.
5,668,537 A 9/1997 Chansky et al.
5,772,166 A * 6/1998 Adams ..... F21V 21/08 248/229.16
5,816,687 A * 10/1998 Tapp ..... F21V 17/107 362/248
5,855,705 A 1/1999 Gauthier
5,893,633 A * 4/1999 Uchio ..... F21K 9/00 257/E25.02
5,924,176 A 7/1999 Lee
5,957,568 A 9/1999 Byers
6,020,825 A 2/2000 Chansky et al.
6,056,422 A * 5/2000 Huang ..... F21V 21/088 362/391
6,109,765 A * 8/2000 Blanton ..... F21V 21/088 248/229.26
6,424,096 B1 * 7/2002 Lowe ..... H05B 37/0272 315/185 R
6,467,929 B2 * 10/2002 Lee ..... A42B 1/242 362/190
6,520,661 B1 2/2003 Hill
6,572,062 B1 6/2003 Limber et al.
6,619,813 B1 * 9/2003 Schnell ..... A44B 15/005 362/116
6,621,235 B2 9/2003 Chang
6,690,120 B2 2/2004 Oskorep et al.
6,761,470 B2 7/2004 Sid
6,801,003 B2 10/2004 Schanberger et al.
6,917,188 B2 7/2005 Kemahan
6,930,455 B2 8/2005 Chansky et al.
6,933,680 B2 8/2005 Oskorep et al.
6,956,493 B1 10/2005 Youngblood
6,965,205 B2 11/2005 Piepgras et al.
7,056,006 B2 6/2006 Smith
D524,975 S * 7/2006 Oas ..... D26/56
7,102,301 B2 9/2006 Oskorep et al.
7,131,748 B2 11/2006 Kazar et al.
7,139,617 B1 11/2006 Morgan et al.
7,161,313 B2 1/2007 Piepgras et al.
7,175,302 B2 2/2007 Kazar et al.
7,180,252 B2 2/2007 Lys et al.
7,186,003 B2 3/2007 Dowling et al.
7,228,190 B2 6/2007 Dowling et al.
7,242,152 B2 7/2007 Dowling et al.
7,244,044 B2 * 7/2007 Liao ..... G09F 13/22 362/158
7,257,551 B2 8/2007 Oskorep et al.
7,332,877 B2 2/2008 Crodian et al.
7,353,071 B2 4/2008 Blackwell et al.
D578,691 S * 10/2008 Lau ..... D26/39
D579,137 S * 10/2008 Shiu ..... D26/60
7,473,002 B1 1/2009 Chen
7,502,034 B2 3/2009 Chemel et al.
7,508,141 B2 3/2009 Wong
7,550,931 B2 6/2009 Lys et al.
7,550,935 B2 6/2009 Lys et al.
7,659,674 B2 2/2010 Mueller et al.
7,737,819 B2 6/2010 Chansky et al.
7,764,026 B2 7/2010 Dowling et al.
7,784,961 B1 * 8/2010 Rawlings ..... F21S 2/00 362/123
7,809,448 B2 10/2010 Lys et al.
7,832,917 B2 11/2010 Chien
7,871,192 B2 1/2011 Chien
7,883,261 B2 * 2/2011 Yu ..... F21V 17/06 362/249.02
7,896,520 B1 * 3/2011 Norling ..... A47J 37/0786 362/191
7,961,113 B2 6/2011 Rabiner et al.
8,002,456 B2 8/2011 Chien
8,007,129 B2 * 8/2011 Yang ..... H05B 33/0803 315/185 S
8,026,673 B2 9/2011 Lys
8,128,274 B2 3/2012 Chien
8,134,303 B2 3/2012 Lys
8,231,260 B2 7/2012 Chien
8,232,745 B2 7/2012 Chemel et al.
8,303,150 B2 11/2012 Chien
8,317,355 B1 11/2012 Wang
8,344,665 B2 1/2013 Verfuerth et al.
8,408,736 B2 4/2013 Chien
8,449,145 B1 * 5/2013 Berry ..... F21S 4/00 362/249.02
8,450,950 B2 5/2013 McRae
8,471,480 B2 6/2013 Kinderman et al.
8,474,995 B2 * 7/2013 Lau ..... F21L 4/027 362/106
8,511,877 B2 8/2013 Chien
8,553,235 B1 10/2013 Lee
8,668,349 B2 * 3/2014 Richardson ..... F21S 9/037 362/183
8,692,786 B2 4/2014 Diederiks et al.
8,714,799 B2 5/2014 Chien
8,721,160 B2 5/2014 Chien
8,746,953 B1 6/2014 Shao
8,764,253 B2 * 7/2014 Ko ..... F21L 4/00 362/190
8,878,451 B2 11/2014 Lee et al.
9,089,017 B2 7/2015 Pang et al.
9,155,154 B2 10/2015 Koch
9,213,324 B2 12/2015 Loveland et al.
9,230,519 B1 * 1/2016 Beller ..... G10D 3/00
D751,377 S * 3/2016 Duffy ..... D8/395
9,304,604 B2 4/2016 Lee
9,306,352 B1 * 4/2016 Lin ..... H01R 4/5066
9,307,617 B2 4/2016 Sako et al.
9,423,885 B2 8/2016 Lee

(56) References Cited

U.S. PATENT DOCUMENTS 9,474,130 B2 10/2016 Van De Sluis et al.
9,497,819 B2 11/2016 Van De Sluis et al.
9,719,654 B2 8/2017 Chien
9,909,739 B2 3/2018 Chien
10,047,922 B2 8/2018 Chien
10,288,235 B1 * 5/2019 Chen ..... H01L 25/0753
2001/0030862 A1 10/2001 Simms
2002/0048169 A1 * 4/2002 Dowling ..... H05B 33/0857 362/234
2002/0105808 A1 8/2002 Ting Yup
2003/0112624 A1 * 6/2003 Quittner ..... F21L 4/045 362/200
2004/0037079 A1 * 2/2004 Luk ..... H05B 33/0857 362/249.06
2004/0119951 A1 6/2004 Vitantonio et al.
2004/0123875 A1 * 7/2004 Kim ..... A45D 29/02 132/73.5
2005/0012003 A1 * 1/2005 Jackson ..... A47G 1/17 248/205.3
2005/0185392 A1 8/2005 Walter et al.
2005/0190078 A1 9/2005 Salter
2005/0221659 A1 * 10/2005 Mrakovich ..... F21V 29/713 439/404
2005/0243558 A1 * 11/2005 Van Duyn ..... F21S 43/15 362/294
2006/0039146 A1 2/2006 Wu
2006/0039147 A1 2/2006 Wu
2006/0067071 A1 * 3/2006 Quittner ..... F21L 4/027 362/201
2006/0076094 A1 * 4/2006 Kaminski ..... A45C 11/182 150/147
2006/0076908 A1 4/2006 Morgan et al.
2006/0120089 A1 * 6/2006 Liberatore ..... F21V 21/08 362/391
2006/0164834 A1 7/2006 Kao
2006/0277823 A1 * 12/2006 Barnett ..... F21V 21/0824 47/33
2007/0019441 A1 * 1/2007 Moreland ..... F21V 21/34 362/648
2007/0127273 A1 * 6/2007 Tsai ..... H01R 13/6675 362/646
2007/0279920 A1 * 12/2007 Lin ..... F21V 23/0407 362/362
2008/0140231 A1 6/2008 Blackwell et al.
2008/0143234 A1 * 6/2008 Yu ..... F21V 17/06 313/318.08
2008/0144325 A1 * 6/2008 Van Dyn Hoven ..... F21V 17/10 362/353
2008/0239716 A1 * 10/2008 Lin ..... F21S 4/26 362/219
2008/0285294 A1 11/2008 Kim
2008/0298058 A1 * 12/2008 Kan ..... F21V 15/01 362/240
2008/0315798 A1 12/2008 Diederiks et al.
2009/0027876 A1 * 1/2009 Yu ..... F21L 4/027 362/184
2010/0084992 A1 4/2010 Valois et al.
2010/0118554 A1 * 5/2010 Kraus, Jr. ..... H02G 3/24 362/396
2010/0214783 A1 * 8/2010 Liu ..... H05K 1/181 362/249.14
2010/0271815 A1 * 10/2010 Gomez ..... F21S 6/001 362/184
2010/0289433 A1 * 11/2010 Lau ..... A42B 1/244 315/313
2011/0063826 A1 * 3/2011 Lau ..... F21L 4/027 362/190
2011/0089841 A1 4/2011 Radermacher et al.
2011/0115407 A1 5/2011 Wibben et al.
2011/0140639 A1 * 6/2011 Shih ..... B25B 9/02 315/362
2011/0222274 A1 * 9/2011 Ko ..... F21L 4/00 362/191
2011/0241549 A1 10/2011 Wootton
2012/0206064 A1 8/2012 Archenhold
2013/0027940 A1 * 1/2013 Zhang ..... F21S 4/10 362/249.06
2013/0094202 A1 4/2013 Wylie
2013/0135333 A1 5/2013 Chen et al.
2013/0148366 A1 * 6/2013 Adams, IV ..... F21V 21/088 362/396
2013/0163250 A1 * 6/2013 Chen ..... H01R 4/242 362/249.06
2013/0182420 A1 7/2013 Richardson
2013/0193872 A1 8/2013 Cousin et al.
2013/0201658 A1 8/2013 Bogart et al.
2013/0240690 A1 9/2013 Florman
2013/0242560 A1 * 9/2013 Hsu ..... F21V 19/001 362/249.06
2013/0294056 A1 * 11/2013 Eibner ..... F21L 4/00 362/184
2014/0085869 A1 * 3/2014 Quittner ..... F21L 4/005 362/103
2014/0091719 A1 4/2014 Tsai
2014/0304961 A1 * 10/2014 Cherry ..... G01R 31/2635 29/402.09
2014/0334648 A1 11/2014 Wang
2014/0335910 A1 11/2014 Wang
2015/0102731 A1 4/2015 Altamura et al.
2015/0109783 A1 4/2015 Peng
2015/0159844 A1 * 6/2015 Flaherty ..... H05B 45/10 362/231
2015/0173157 A1 6/2015 Setomoto et al.
2015/0354768 A1 12/2015 Gaumann
2016/0021724 A1 1/2016 Kinderman et al.
2016/0047516 A1 * 2/2016 Taylor ..... F21S 8/036 362/368
2016/0165809 A1 6/2016 Mason
2016/0327253 A1 * 11/2016 Martinez ..... A61B 90/30
2017/0237841 A1 * 8/2017 Duffy ..... H04M 1/0281 206/316.2
2018/0320867 A1 * 11/2018 Chang ..... F21S 4/10
2018/0320868 A1 * 11/2018 Chang ..... F21V 21/088

FOREIGN PATENT DOCUMENTS

CN 104964173 A 10/2015
DE 102011055449 A1 8/2012
EP 1703197 A2 9/2006
WO 2001/005195 A1 1/2001
WO 2001/082657 A1 11/2001
WO 2001/099475 A1 12/2001
WO 2003/067934 A2 8/2003
WO 2005/084339 A2 9/2005
WO 2008/131524 A1 11/2008
WO 2016/049731 A1 4/2016

OTHER PUBLICATIONS

Castle, Alex, "How to Get Started with Programmable RGB LED Strip Lighting," published Feb. 21, 2013, obtained Dec. 1, 2016 from: <http://www.tested.com/art/makers/453665-how-get-started-programmable-rgb-led-strip-lighting/>, 9 pgs.
Elektric-Junky-2013, LED WIFI Controller RGB Strip Instruction how to control LED Lights With your Smartphone or iPad, published Aug. 31, 2013, obtained Dec. 1, 2016 from: <http://shop.elektric-junkys.com/WIFI-LED-RGB-Strip-controller-RGB-and-single-color-11.htm>, 3 pgs.
Greners, <http://www.greners.com/i/grow-lights/products/light-boxes-controllers.html>, printed on Dec. 9, 2013.
LED Multi-Function Programmable Strips, <http://www.environmentallights.com/led-christmas-lights/led-multi-function-programmable-strings.html>, printed on Dec. 9, 2013.
LED Wholesalers 16.4 Ft RGB Color Changing Kit with LED Flexible Strip, <http://www.amazon.com/LEDwholesalers-Controller-2034RGB-3315-3215/dp/B0040FJ27S>, Dec. 9, 2013.
Lumenplay/Crowd Supply, published Jun. 28, 2013, obtained Dec. 1, 2016 from: <https://web.archive.org/web/20130628021733/http://www.crowdsupply.com/rigado/lumenplay>, 25 pgs.

(56) References Cited

OTHER PUBLICATIONS

Wonderful Christmas Ornaments 5m 300 × 3528 SMD LED RGB Light Waterproof, <http://www.lights-box.com/wonderful-christmas-ornament-5m-300-x-3528-smd-led-rgb-light-waterproof-led-strip-light-with-power-supply-and-remote-control>, printed on Dec. 9, 2013.

* cited by examiner

CLIP LIGHTS AND RELATED SYSTEMS

TECHNICAL FIELD

This patent application relates generally to lighting systems and components. More specifically, this patent application relates to clip on lighting systems and components, for example, for use in or around a building, such as a house, or surrounding structures.

BACKGROUND

Lighting systems are commonly used for decorative or environmental purposes. For example, during the holidays, people often place electric lights on their houses or landscaping surrounding their houses. These lights typically consist of one or more lengths of conductive wire, each length of wire having multiple lights (e.g., light bulbs) distributed there along. The lengths of wire and/or lights can be secured to the house, landscaping, or other object in various ways, such as by wrapping the wire around the object, or using fasteners such as nails or tacks.

SUMMARY

In an embodiment, a clip light can include a clip having a first clamp member and a second clamp member that opposes the first clamp member, wherein the first clamp member and the second clamp member are elastically biased towards one another; a light emitting diode located on the first clamp member; and a light unit cover that encloses the light emitting diode.

In an embodiment, a lighting system can include: a plurality of clip lights that include a clip having a first clamp member and a second clamp member that opposes the first clamp member, wherein the first clamp member and the second clamp member are elastically biased towards one another; a light emitting diode located on the first clamp member; and a light unit cover that encloses the light emitting diode. The plurality of clip lights can be arranged into a light string by wires. The lighting system can include a power adapter that transmits power to the plurality of clip lights through the wires and a set of wires that connects the plurality of clip lights to the power adapter.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

Embodiments will now be described in connection with the associated drawings, in which.

DETAILED DESCRIPTION OF THE DRAWINGS

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without departing from the spirit and scope of the invention. It is to be understood that each specific element includes all technical equivalents that operate in a similar manner to accomplish a similar purpose. The examples and embodiments described herein are non-limiting examples.

The present application relates to a decorative lighting system including a string of light modules, or "clip lights" that can be easily clipped on and off of a house or other structure. Multiple strings of the lights can be connected together in series and/or parallel in order to provide a scalable system. A control system, either hardwired into one or more of the strings, or provided remotely, can be used to set various colors and illumination patterns, as may be desired by the user, for example, to provide various holiday themes. Embodiments of the system are described below. It will be understood by one of ordinary skill in the art, based on this disclosure, that features described in connection with one embodiment may be used with other embodiments.

First Embodiment

Figure 1:
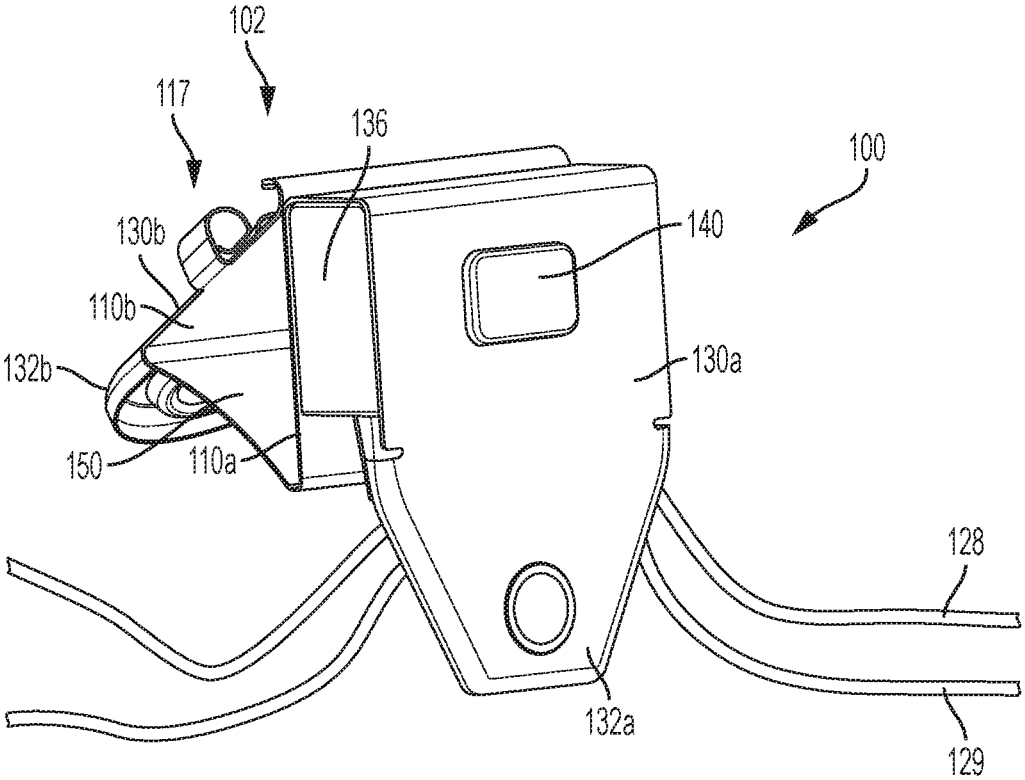
FIG. 1 depicts a perspective view of a clip light in a relaxed state, according to a first embodiment of the invention.

As shown in FIG. 1, a clip light 100 can include a clip 102 having a first clamp member 110*a* and a second clamp member 110*b* that opposes the first clamp member 110*a*. The first and second clamp members 110*a*, 110*b* can be resilient jaw portions that are biased towards each other, for example, elastically. This may be accomplished, for example, by forming the clamp members 110*a*, 110*b* from elastic materials, such as spring steel. The first and second clamp members 110*a*, 110*b* can be independently formed or can be integrally joined, for example, by a connecting base 150. The first and second clamp members 110*a*, 110*b* can be biased towards one another, for example, in an inwardly angled orientation. According to embodiments, the clip 102 can have a cross-section substantially in the shape of an isosceles triangle with the first and second clamp members 110*a*, 110*b* making up the legs of substantially equal length and the connecting base 150 making up the base of the triangle. Tension along the first and second clamp members 110*a*, 110*b*, and/or the connecting base 150 can bias the two sides to make contact one with another. Thus, in a relaxed state the first and second clamp members 110*a*, 110*b* can extend along planes that are not parallel to each other. The clip 102 can be made of metal, plastic, composite material, or any other durable and resilient material.

The clip 102 can include first and second exterior plates 130*a*, 130*b* that are connected to the first and second clamp members 110*a*, 110*b*, respectively. For example, the first and second exterior plates 130*a*, 130*b* can be bonded, welded, or fastened to the clamp members 110*a*, 110*b*, or alternatively, can be formed integrally therewith. The first and second exterior plates 130*a*, 130*b* can cover the exterior of the first and second clamp members 110*a*, 110*b*, respectively. The first and second exterior plates 130*a*, 130*b* each can have a height that is greater than a height of the first and second clamp members 110*a*, 110*b*, respectively. For example, the first and second exterior plates 130*a*, 130*b* can each have handle portions 132*a*, 132*b* that extend below the first and second clamp members 110*a*, 110*b*, respectively. The handle portions 132*a*, 132*b* can serve as levers in the positions indicated in FIG. 1 to allow the user to use his or her fingers to spread the first and second clamp members 110*a*, 110*b* apart from one another, for example, to the position shown in FIG. 3. When an inward pressure is applied on the handle portions 132*a*, 132*b*, they can spring the clip 102 open. Releasing the inward pressure, and/or applying outward pressure can allow the clamp members 110*a*, 110*b* to elastically spring back toward one another.

The clip 102 can be configured to attach to a roof board, for example, with the clamp members 110*a*, 110*b* on opposite sides of the board. The clip light 100 can include a light unit 120 (see FIG. 2) provided on at least one of the first and second clamp members 110*a*, 110*b*.

As shown in FIG. 1, one or more loops 117 can be disposed on an edge of clamp member 110*b*. The hook 117 can allow a neat and orderly organization of the wires 128, 129 and clip lights 100 when in a string of clip lights.

As can be seen from FIG. 1, a housing 136 can be positioned in between first clamp member 110*a* and first exterior plate 130*a*. The housing 136 can include a vertical support 114 (FIG. 2) that can interface with the handle portion 132*a* of the first exterior plate 130*a*. The housing 136 can thus provide for a more stable opening of the clip 102. Additionally, the housing 136 can enclose the light unit 120 and other electrical components, as will be described in more detail below.

Figure 3:
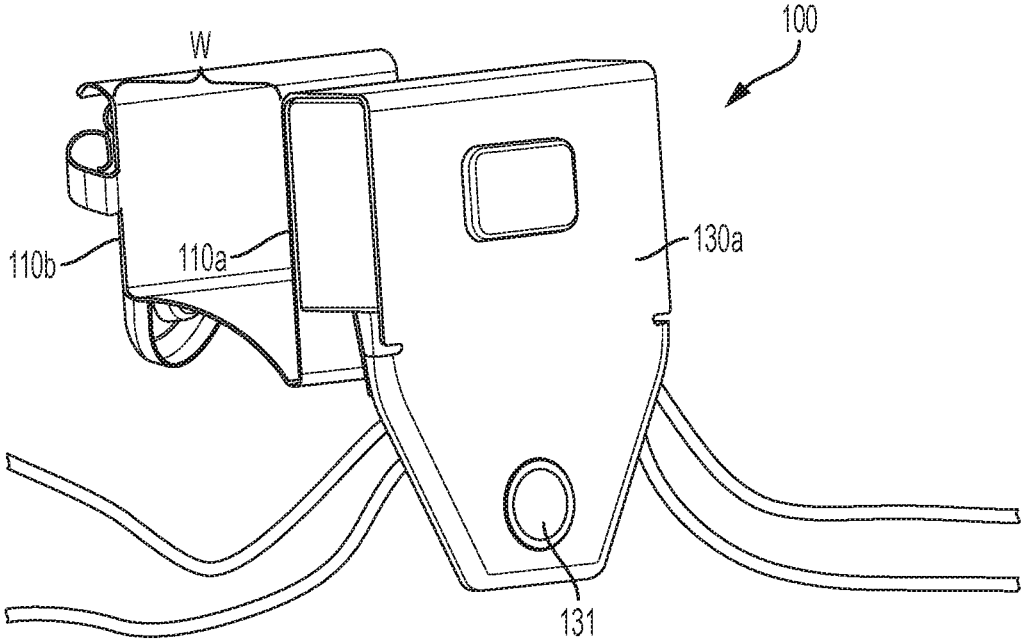
FIG. 3 depicts a perspective view of a clip light in an expanded state, according to the first embodiment of the invention.

As shown in FIG. 3, the clip light 100 in the expanded state can have the first and second clamp members 110*a*, 110*b* extend along planes that are substantially parallel to each other. The distance between the clamp members 110*a*, 110*b* in the expanded state is represented by W and can correspond to the maximum width of the structure to which the clip light 100 can attach, for example, without permanently deforming the clip.

Figure 2:
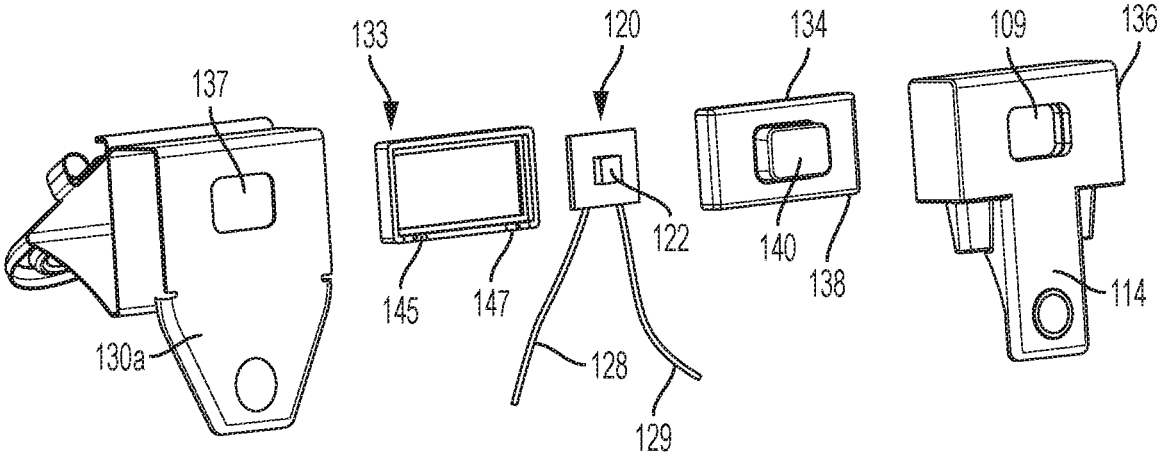
FIG. 2 depicts an exploded view of the clip light of FIG. 1.

Referring to FIG. 2, the housing 136 can house the light unit 120. The light unit 120 can comprise one or more light emitting diodes (LEDs) 122 or laser diodes (LDs), or other light sources, such as miniature incandescent bulb(s). The light unit 120 can have one or more electrical wires 128, 129 connected thereto. The LED 122 can be a surface mounted LED, as shown, however, other types of LEDs are contemplated such as chip-on-board or multiple chip-on-board LEDs. The LEDs can be multi-color RGB LEDs and configured to emit a variety of colors. Alternatively, the LEDs can be white LEDs. The housing 136 can also house a light unit cover 134, which can be made of a bottom light unit cover 133 and an upper light unit cover 138. The light unit cover 134 can be a weather resistant clamshell housing that can be completely transparent or translucent, or can be opaque with a transparent or translucent window 140. The light unit cover 134 can house a circuit board (such as a printed circuit board) supporting the light unit 120 in electrical connection with the wires 128, 129. The bottom light unit cover 133 can also contain a heat sink (not shown) in thermal communication with the circuit board, such that the heat sink draws heat away from the circuit board and light unit 120, to maintain an acceptable temperature for the electrical components. According to embodiments, the heat sink can be formed of metal, such as aluminum alloy, copper, composites, or combinations thereof. The heat sink can also include fins (not shown) or other features configured to further draw heat away from the circuit board.

The light unit covers 133, 138 can together define one or more grooves or recesses 145, 147 for wires 128, 129 to extend from the light unit cover 134 to outside the clip 102. As mentioned previously, the upper light unit cover 138 can include a window 140 that projects above the top surface of the upper light unit cover 138. The window 140 can be made of a transparent or translucent material that allows light from the light unit 120 to be transmitted therethrough. As shown in FIG. 2, the housing 136 can define a hole 109 that allows for the window 140 to extend through. In addition, the first exterior plate 130*a* can define an aperture 137 that similarly allows for the window 140 to extend through or that allows for light from the light unit 120 to be transmitted outwardly. According to an embodiment, window 140 projecting through the hole 109 and aperture 137 can retain the housing 136 on the first clamp member 110*a*. Alternatively, adhesives or fasteners can be used to retain the housing 136 on the first clamp member 110*a*. The light unit cover 134 can be made of hard plastic, metal, composite, or other durable material. As shown in FIG. 3, a finger grip pad 131 can be provided on the first exterior plate 130*a*. A similar structure can be provided on the second exterior plate 130*b*.

Figure 4A:
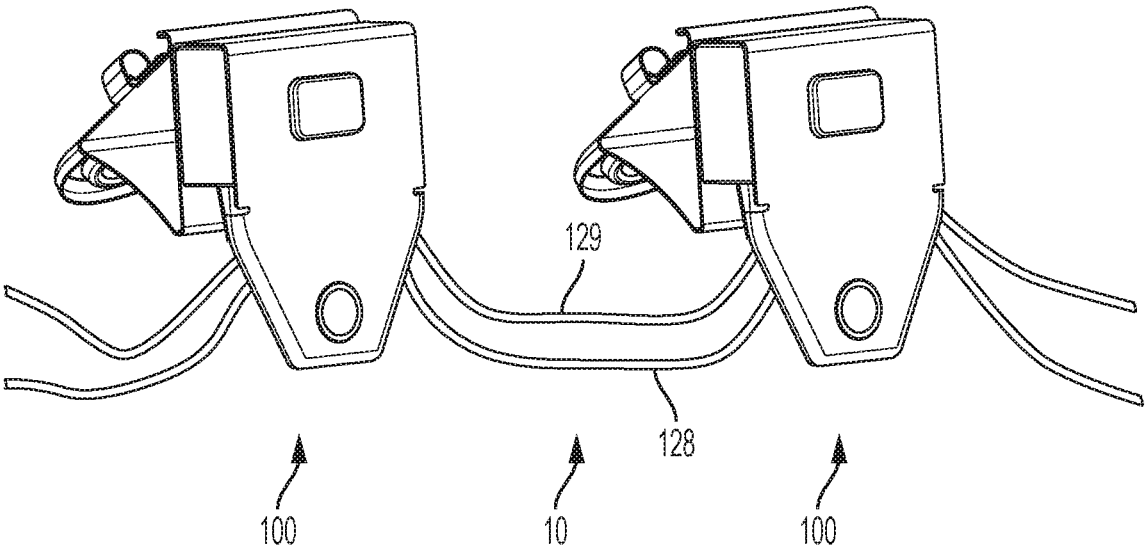
FIG. 4A depicts a perspective view of a string of clip lights, according to the first embodiment of the invention.
Figure 4B:
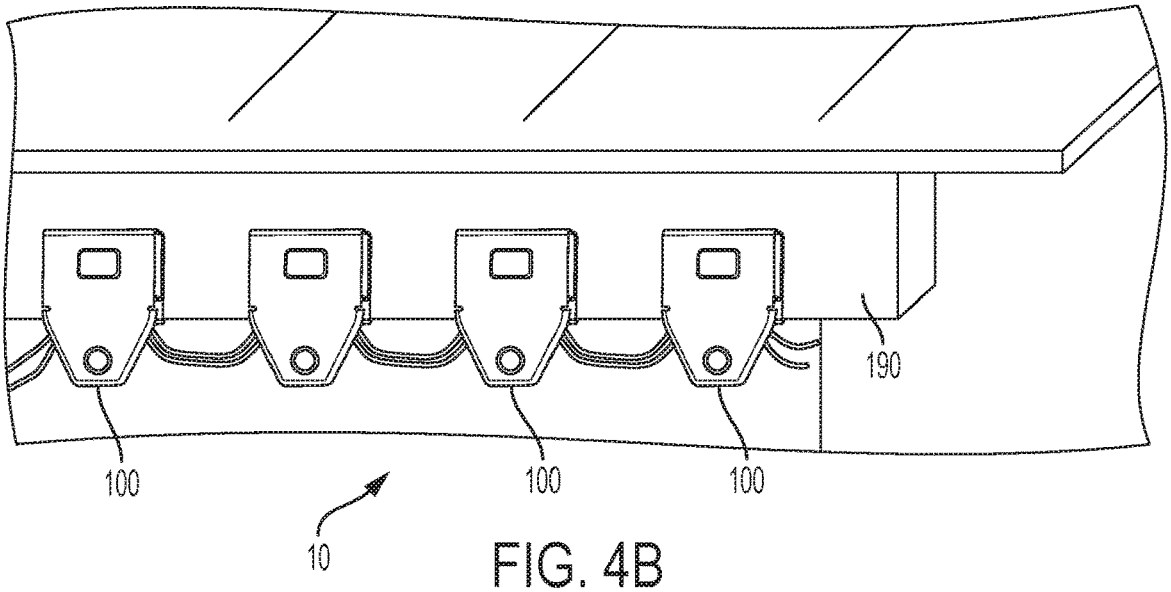
FIG. 4B depicts a perspective view of a string of clip lights mounted to an eaves, according to the first embodiment of the invention.
Figure 4C:
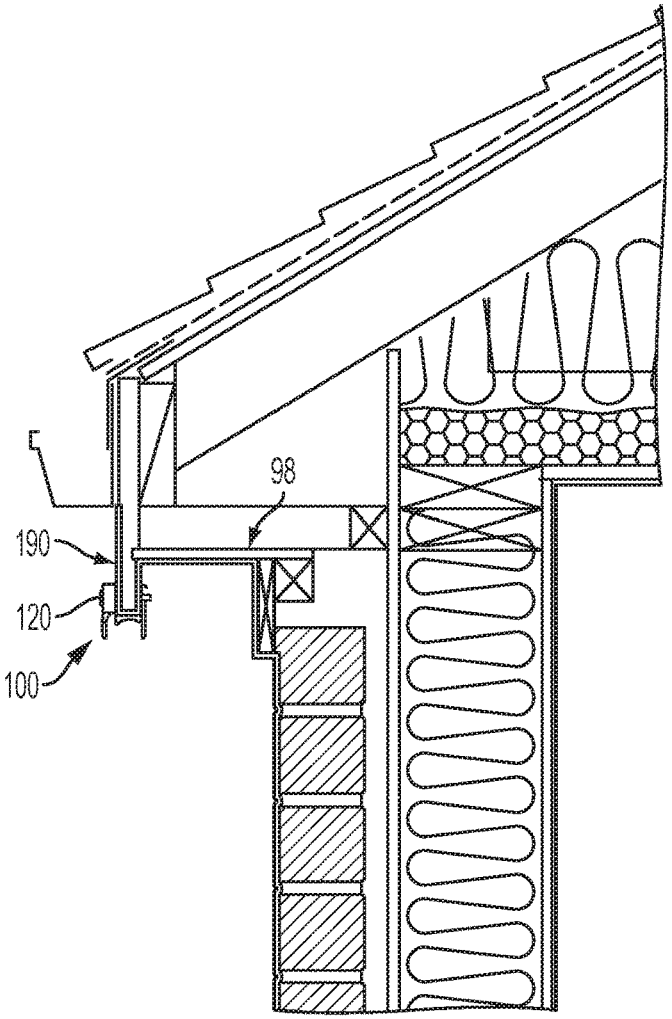
FIG. 4C depicts a side, partially cross-sectional view of a clip light mounted to an eaves, according to the first embodiment of the invention.

According to an embodiment, as shown in FIG. 4A, a lighting system 10 can include a plurality of clip lights 100 connected in series, for example, by wires 128, 129. For example, the lighting system 10 can include 2, 3, 4, 5, 10, 15, 20, or any number of clip lights 100 as may be desirable for a particular application. FIG. 4A depicts an embodiment of lighting system 10 detached from a building or other object. The lighting system 10 can be attached to a structure, such as a fascia board 190, as shown in FIGS. 4B and 4C, although other structures that can fit within the clip are contemplated. FIG. 4B shows a plurality of clip lights 100 mounted to the fascia board 190 or in a suitable place; however, other mounting locations are possible. The housing and mounting clip can facilitate mounting the clip lights to the fascia or under the eave, or on some other structure, for extended periods of time.

FIG. 4C depicts a side profile view of the mounted clip light 100 on a fascia board 190 that can extend from a roof and/or soffit 98. The light unit 120 of the clip light 100 can project away from the structure to which the clip light 100 is attached.

Figure 4D:
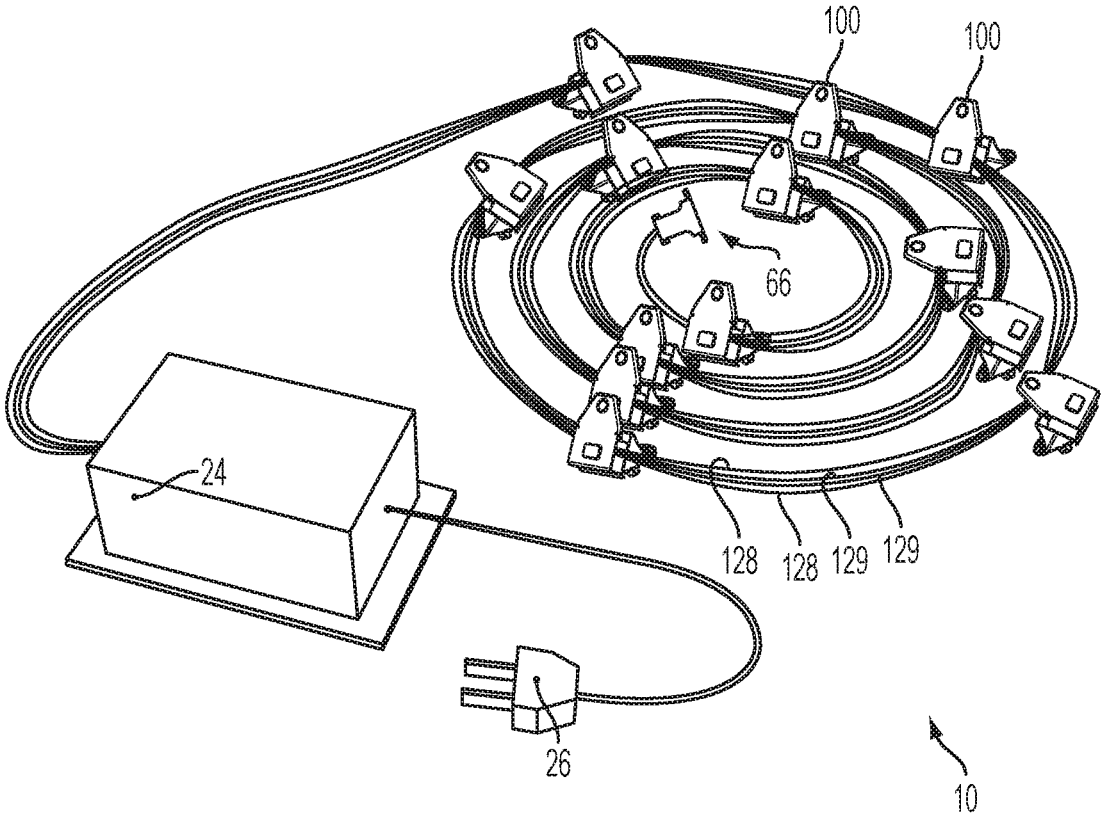
FIG. 4D depicts a perspective view of a light system including a plurality of clip lights, according to the first embodiment of the invention.

As shown in FIG. 4D, the lighting system 10 can include a plurality of the clip lights 100 connected by the wires 128, 129, as described above. The system can also include a power adapter 24 that receives electrical power, for example, from a power supply 26, such as an AC plug or other connector adapted to plug into an electrical outlet, such as an 110V, 120V, 220V, or 240V AC outlet or an appropriate battery that provides power. The system can also include a controller (not shown) connected between the power adapter 24 and the string of clip lights 100. According to an alternative embodiment, the power adapter 24 and the controller can be integrated into a single unit. Mating cord couplers 66 can be provided to facilitate disconnecting and reconnecting the wires 128, 129 to the controller 24, and/or to facilitate connection of multiple strings of clip lights in an end-to-end arrangement, for example, to extend the length of the lighting system. According to embodiments, the cord couplers 66 can be weather resistant, e.g., they can form a water tight seal around the underlying electrical components. This can be accomplished, for example, by using couplers 66 having plastic or rubber material with mating threaded portions, or by using threaded metal couplers having a rubber gasket, O-ring, or the like. One of ordinary skill in the art will appreciate from this disclosure that other structures can be used to from a weatherproof connection between adjoined couplers 66, including those without threads.

A portable electronic device or handheld wireless remote can interface with the controller to adjust the lights, e.g., using Bluetooth, Wifi, IR, or other wireless technology. The controller can also be a portable electronic device (such as a smart phone) with a Bluetooth or Wifi connector, etc. In addition to the input buttons on the face of the controller, the portable electronic device can be configured to connect with the controller to operate all functions of the controller using the keys on the portable electronic device. The portable electronic device may connect to the controller using infrared or RF wireless transmission protocols and systems known in the art. Likewise, the controller may include other wireless communication hardware and firmware to allow the controller to receive control signals from a wireless device such as a smartphone, smart tablet, computer, or other computer based system having a processor, executable instructions (such as a smartphone app) and wireless communication capabilities. For such wireless communications, the wireless device can communicate with the controller using a wireless network and communicate through a wireless router such that the wireless device sends and receives signals from the controller through the wireless network router, such as a Wi-Fi router. Likewise, the wireless device can communicate directly with the controller if the wireless controller includes wireless communication hardware, such as a Wi-Fi or Bluetooth chip configured for direct communication with a handheld or other wireless device.

Thus, the lights can be wirelessly controlled to turn each on and off under the control of the built in controller, or a remote controller or smart device. The controller can be used to create different colors and/or illumination patterns. The controller can be programmed to provide a variety of user-selectable light shows, such as seasonal and/or year-round light shows. For example, according to embodiments, the user can scroll through a menu and select a light pattern they desire. Different lighting patterns can range from steady burn to light changing, color changing, blinking lights, chasing lights, and other patterns and sequences as may be desired by the user.

According to embodiments, lighting system 10 can include a distributor that allows multiple strings of lights 100 to branch off from the power adapter and/or controller, for example, in parallel. Accordingly, a series-parallel configuration is possible where multiple strings of series-connected clip lights 100 are connected in parallel. The distributor can be a stand-alone unit, or alternatively, the distributor can be integrated with the controller and/or the power adapter 24. The distributor can also be connected to the controller and/or power adapter 24 by removable connection, such as by weatherproof couplers 66 described above.

Figure 5:
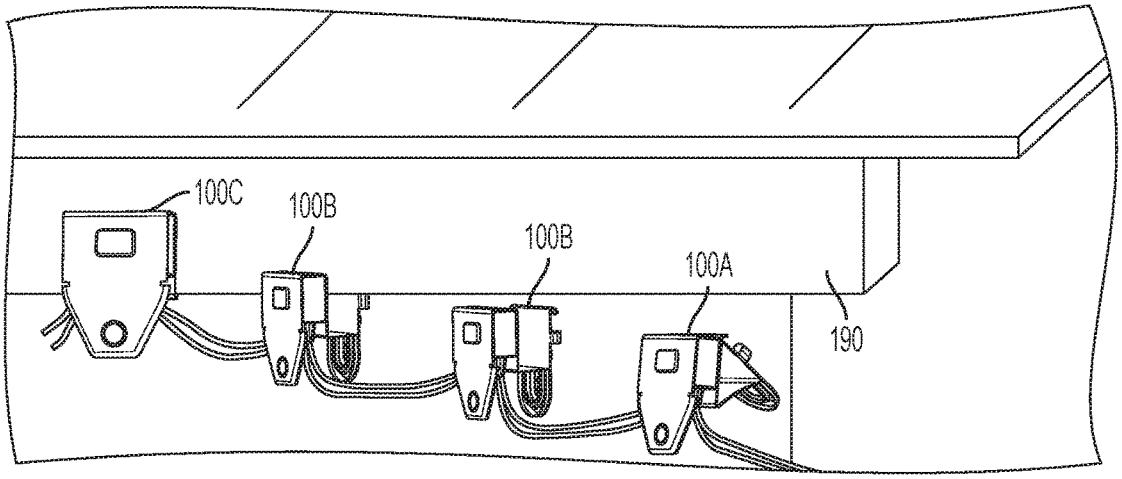
FIG. 5 depicts a perspective view of a string of clip lights being connected to an eaves, according to the first embodiment of the invention.

FIG. 5 shows the various stages of the clip light 100 being attached to a structure, for example, underneath the eaves of a roof. Clip light 100A is depicted in a relaxed state. Clip lights 100B are depicted in an expanded state. Clip light 100C is depicted gripping the structure 190.

Second Embodiment

Figure 6:
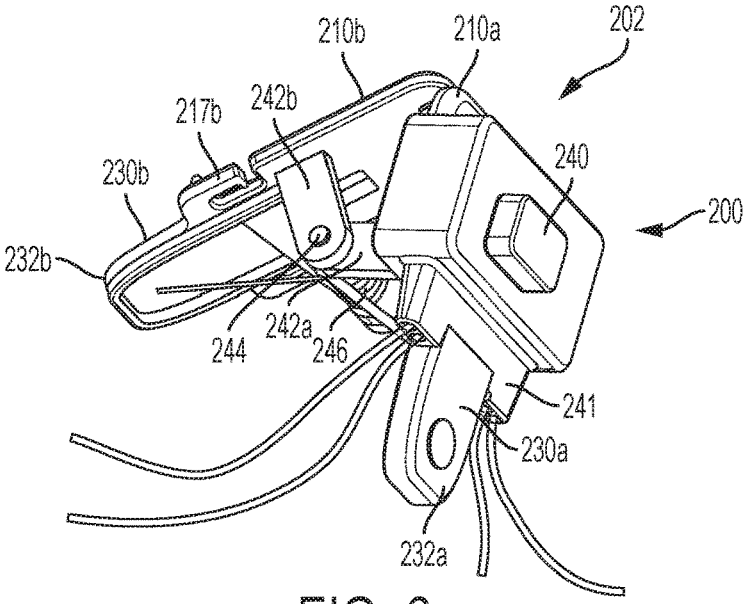
FIG. 6 depicts a perspective view of a clip light in a relaxed state, according to a second embodiment of the invention.
Figure 7:
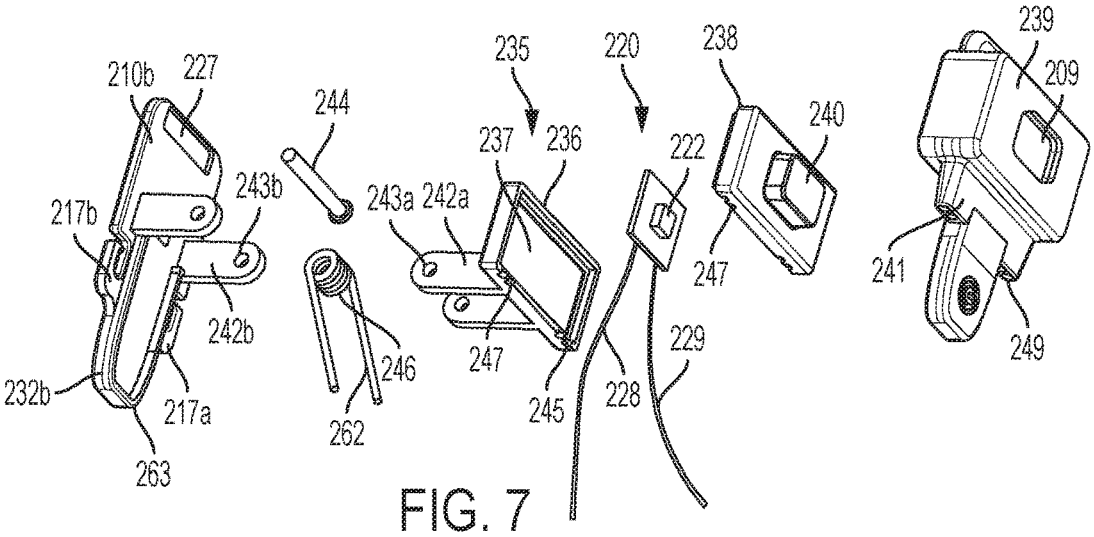
FIG. 7 depicts an exploded view of a clip light according to the second embodiment of the invention.

A second embodiment of a clip light according to the present invention is shown in FIGS. 6-11. As shown in FIGS. 6 and 7, the clip light 200 can comprise a clip 202 having first and second clamp members 210*a*, 210*b*. The clamp members 210*a*, 210*b* can each have extension arms 242*a*, 242*b*, respectively that each define a hole 243*a*, 234*b*. A pin 244 can extend through holes 243*a*, 243*b* (see FIG. 7) in the extension arms 242*a*, 242*b* to form a hinge between the first clamp member 210*a* and second clamp member 210*b*. The pin 244 can be retained in place using known structures, such as an interference fit, deformation, flared ends, bonding, or other feature. The clamp members 210*a*, 210*b* can be biased towards each other by means of a spring 246 disposed in between the two members. For example, spring 246 can comprise a torsion spring having its coil encircle the pin 244. The arms 262 of the spring 246 can push out against the clamp members 210*a*, 210*b*. The clamp members 210*a*, 210*b* can include an outer ridge 263 that keeps the spring arms 262 from slipping off the clamp members 210*a*, 210*b*. The pin 244 can be made of any sturdy and resilient material including metal, hard plastic, wood or a composite material. The clamp members 210*a*, 210*b* can be made of metal, plastic, composite material, or any other durable and resilient material.

Figure 8:
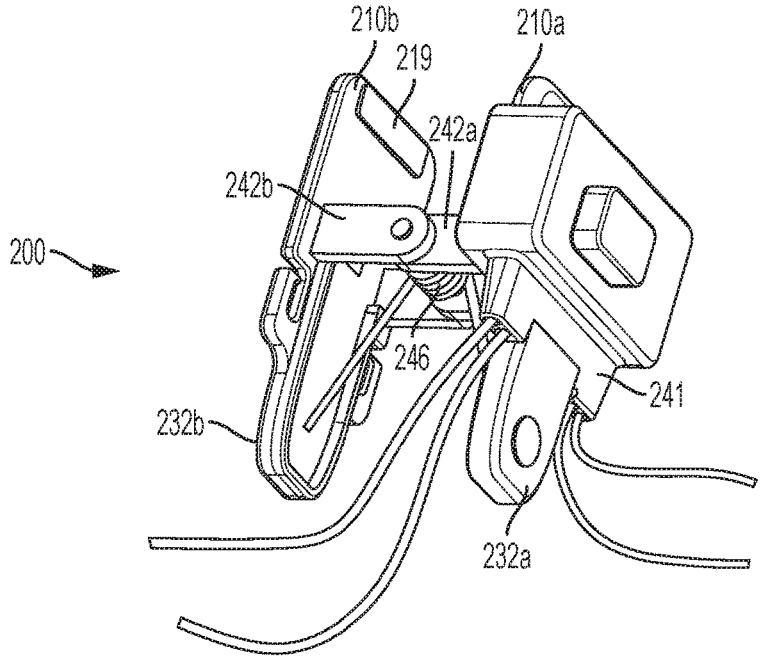
FIG. 8 depicts a perspective view of a clip light in an expanded state, according to the second embodiment of the invention.

The functionality of opening the clip 202 can be similar to that described with respect to the clip light of the first embodiment. When pressure is applied to a lower portion 232*a*, 232*b* of the exterior surface 230*a*, 230*b* of the clamp members 210*a*, 210*b*, the clamp members pivot about the pin 244 against the force of the spring 246, and the top-most portion of the clamp members open, as shown in FIG. 8. Releasing pressure from the lower portions 232*a*, 232*b* allows the spring 246 to recoil, causing the clamp members 210*a*, 210*b* to clamp against one another, or against an object located therebetween. The clamp members 210*a*, 210*b* can be released from a structure by further applying pressure to the lower portions 232*a*, 232*b* of the clamp members 210*a*, 210*b*, which allows the user to free the clamp members 210*a*, 210*b* from contact with the structure.

As shown in FIG. 7, the first clamp member 210*a* can include a housing 235 defined by a light unit cover 236 and an upper light unit cover 238. The housing 235 can define a compartment 237 that can house the light unit 220. The light unit 220 can comprise a surface mounted LED 222 or other light source, similar to the light unit of the first embodiment. The bottom light unit cover 236 can define one or more grooves 245, 247 for wires 228, 229 to travel through. The upper light unit cover 238 can include a light window 240 that can protrude upward from the exterior surface of the upper light unit cover 238. The upper light unit cover 238 can define grooves 247 that can align with the grooves 245 of the bottom light unit cover 236. When the bottom and upper light unit covers 236, 238 are connected, the grooves can define apertures for wires 228, 229 to travel through. Clamp member 210*a* can include exterior housing 239 that can cover the housing 235. The exterior housing 239 can include a bottom portion 241 having apertures 249 (see FIG. 7) for wires 228, 229 to pass through. The bottom portion 241 can thus serve as an interface for the wires 228, 229 coming in and out of the clip light 200. In an embodiment, two apertures on a left side can allow for two wires to pass while two apertures on a right side can allow two wires to pass. This can allow for two wires to enter the exterior housing 239 and two wires to exit. Other embodiments are possible.

Clamp member 210*a* can include one or more hooks 217*a*, 217*b* that can receive one or more wires 228, 229 for a tidy and/or secure wire placement. For example, the hooks 217*a*, 217*b* can allow for the wires to be secured in the case where the clip lights 200 are positioned close to each other and there is slack.

An upper portion of the first and second clamp members 210*a*, 210*b* can include a recess 227 that can receive a friction-enhancing pad 219 (see FIG. 8) such as rubber or elastomer to provide a secure grip onto an object. As shown in FIG. 7, the exterior housing 239 can define a hole 209 that allows for window 240 to extend through, similar to the clip light of the first embodiment. According to an embodiment, window 240 projecting through hole 209 can retain the exterior housing 239 on the first clamp member 210*a*. Alternatively, adhesives or fasteners can be used to retain the exterior housing 239 on the first clamp member 210*a*.

Bottom and upper light unit covers 236, 238 can be made of any durable and resilient material such as, for example, hard plastic, metal, composite material, etc. Window 240 can be made of any durable yet transparent or translucent material that can shield the light unit from external elements, but still allow for light to be transmitted through. Light unit cover 238 can be formed monolithically with window 240, or alternatively, they can comprise two separate parts joined together. Both light unit cover 238 and window 240 can be transparent or translucent, or alternatively, the light unit cover 238 can be opaque while window 240 is transparent or translucent.

Figure 9:
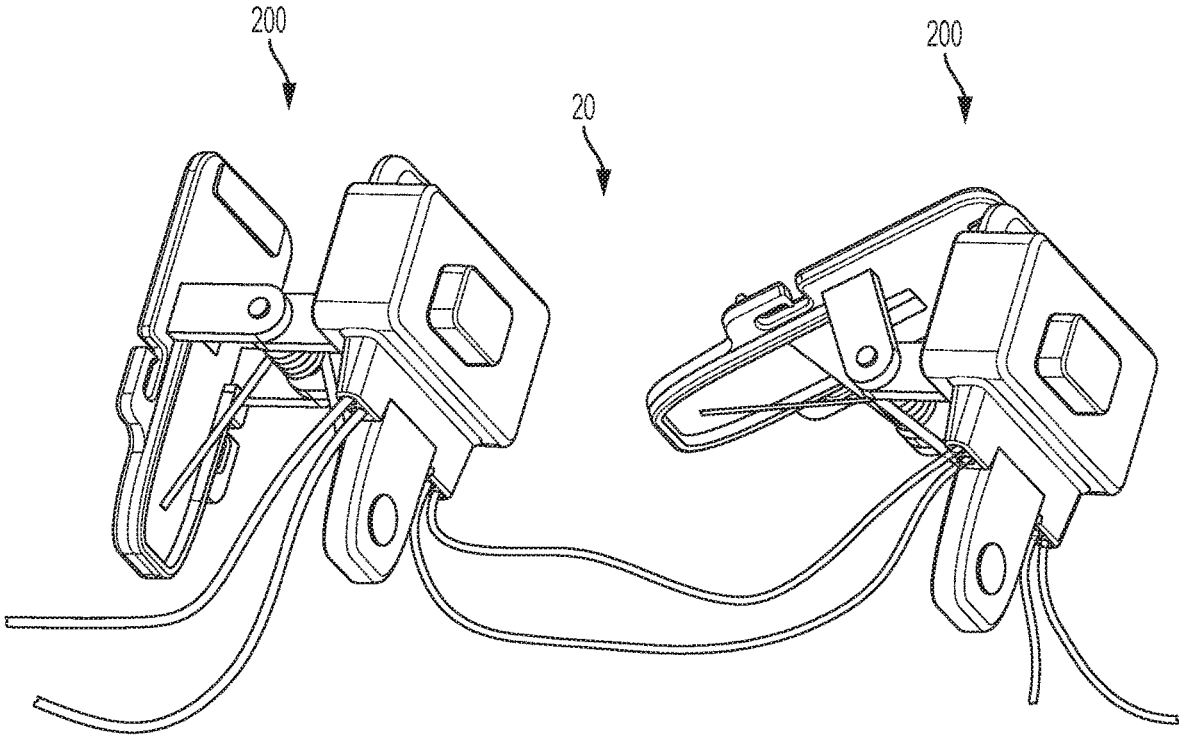
FIG. 9 depicts a perspective view of a string of clip lights in a relaxed state and an expanded state, according to the second embodiment of the invention.
Figure 10:
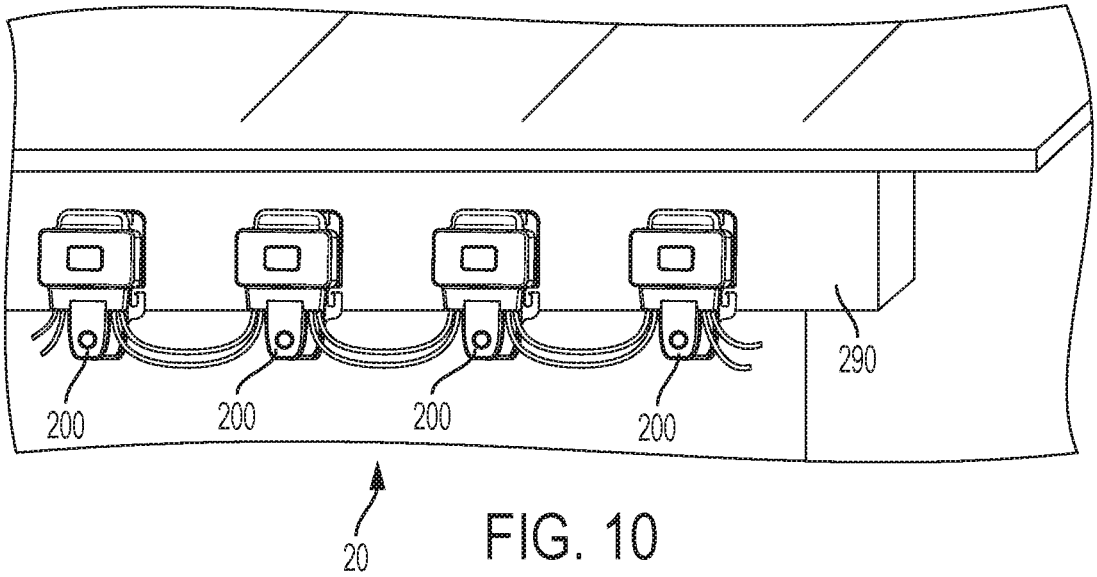
FIG. 10 depicts a perspective view of a string of clip lights connected to an eaves, according to the second embodiment of the invention.
Figure 11:
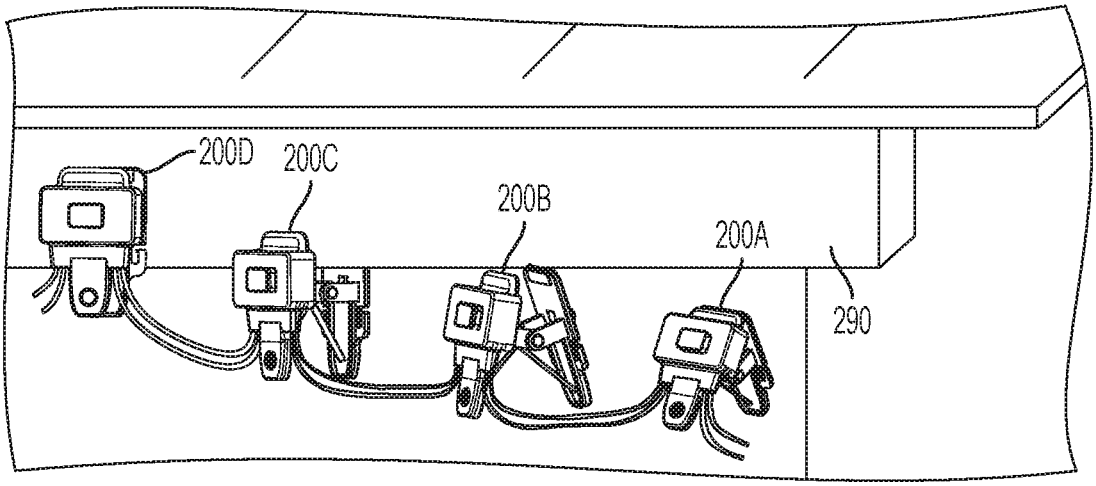
FIG. 11 depicts a perspective view of a string of clip lights being connected to an eaves, according to the second embodiment of the invention.
Figure 12:
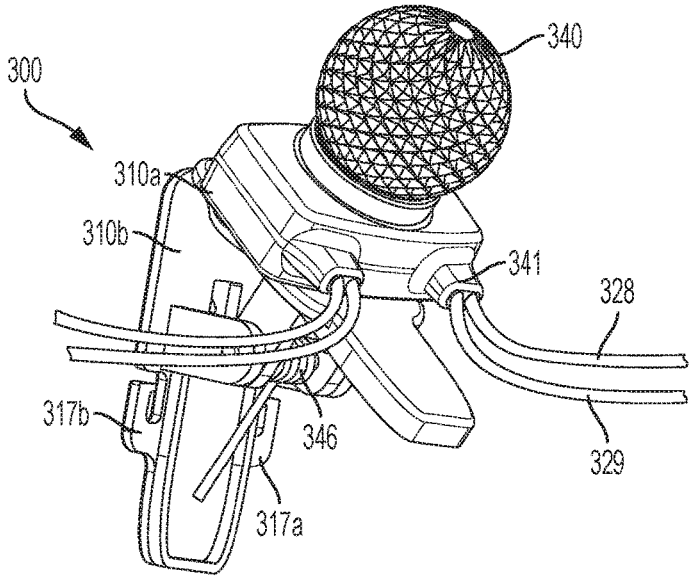
FIG. 12 depicts a perspective view of a clip light, according to a third embodiment of the invention.

FIG. 8 shows clip light 200 in an open, expanded state. FIG. 9 shows a light system 20 having a string of clip lights 200 according to the second embodiment. FIG. 10 shows the light system 20 mounted to a structure 290. FIG. 11 shows the various stages of the clip light 200 going from a clip light 200A in a relaxed and closed state to a clip light 200B in a more expanded state, to a clip light 200C in an open state, and to a clip light 200D in a mounted state, where it is attached to fascia board 290.

The clip lights 200 can be connected into one or more strings, such as described in connection with the first embodiment. Illumination of the lights 200 can be controlled using a variety of different controllers electrically coupled to the lighting system, similar to the structures and functions disclosed with reference to the first embodiment.

Third Embodiment

Figure 13:
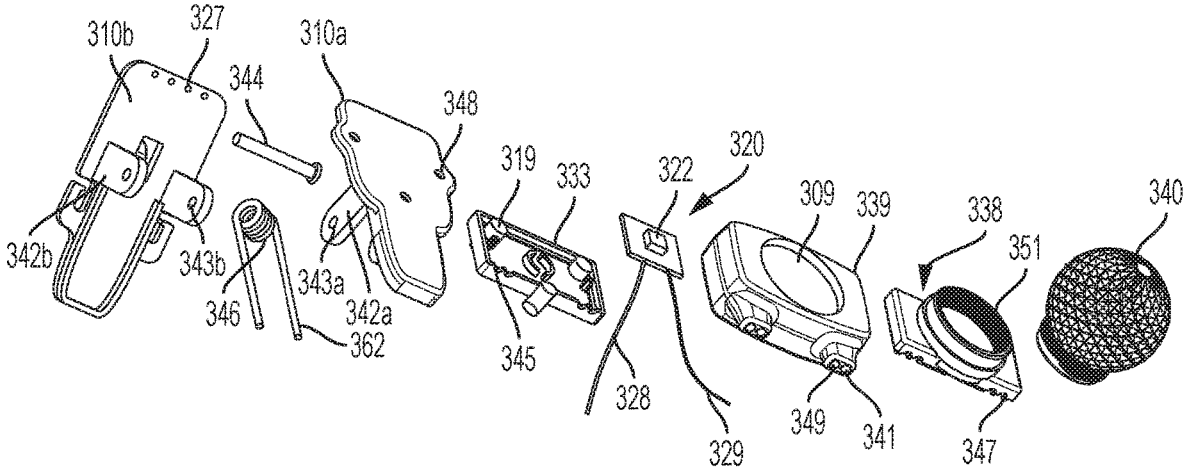
FIG. 13 depicts an exploded view of a clip light, according to the third embodiment of the invention.

FIGS. 12-16 depict a third embodiment of a clip light 300. Similar to the second embodiment, and as shown in FIG. 13, a first clamp member 310*a* and an opposing second clamp member 310*b* can include extending arms 342*a*, 342*b* each having distal apertures 343*a*, 343*b*. A pin 344 can extend through the distal apertures 343*a*, 343*b* to create a hinge that connects the extending arms 342*a*, 342*b* of the first and second clamp members 310*a*, 310*b*. As with the second embodiment, an elastic member such as a torsion spring 346 can extend around the pin 344 and bias the clamp members 310*a*, 310*b* toward one another using its arms 362.

On a surface opposite the extension arms 342*a*, 342*b*, the first clamp member 310*a* can have a plurality of fastening locations (e.g., three) in the form of holes 348 for securing an exterior housing 339. The exterior housing 339 can be connected to the first clamp member through bottom light unit cover 333, for example, by having a fastener extend through holes 348 into bosses 319, however, other ways to fasten exterior housing 339 to first clamp member 310*a*, such as adhesive, are possible. The bottom light unit cover 333 can define grooves 345. The bottom light unit cover 333 can interface with an upper light unit cover 338 that can share complementary grooves 347 that cooperate with grooves 345 to permit passage of wires 328, 329. The exterior housing 339 can include apertures 341, 349 for the passage of wires 328, 329. The upper and lower light unit covers can house the light unit 320, which can comprise a light source 322, such as one or more LEDs or other light producing elements, similar to previous embodiments. The upper light unit cover 338 can include a lip 351 that is configured to receive a lens 340, such as a beam splitter kaleidoscope lens.

Hooks 317*a*, 317*b* can project away from at least one of the first and second clamping members. The hooks 317*a*, 317*b* can be configured to receive one or more wires 328, 329 for a tidy and/or secure wire placement.

The lens 340 can comprise a beam splitter that is substantially globe-shaped. The lens 340 can define a substantially hollow interior region. A plurality of facets can be distributed about the inner and/or outer surface of the lens 340, for example, in order to create a dimpled surface. The facets can focus the light from the light unit 320 into multiple individual beams. According to embodiments, the lens 340 can have a smooth surface, a textured surface, an irregular surface, or combinations thereof. Different surfaces can allow for different patterns for the emitted light. The lens 340 can be made of plastic, a hard plastic, glass, or other durable but translucent or transparent materials. The clamping members 310*a*, 310*b*, bottom unit light cover 333, and exterior housing 339 can be made of any durable and resilient material such as plastic, metal, composite, etc.

In an embodiment, the lip 351 of the upper light unit cover 338 can project through an aperture 309 in the exterior housing 339. The exterior housing 339 can house the upper and bottom light unit covers 333, 338, or at least a portion thereof.

The interior surface of the first and second clamp members 310*a*, 310*b* can include one or more friction-enhancing features, such as protuberances 327, that facilitate gripping to the item the clip attaches to. As shown, the protuberances can be located at a top-most portion of the interior surface of the first and second clamp members 310*a*, 310*b*, however, other locations are possible.

Figure 14:
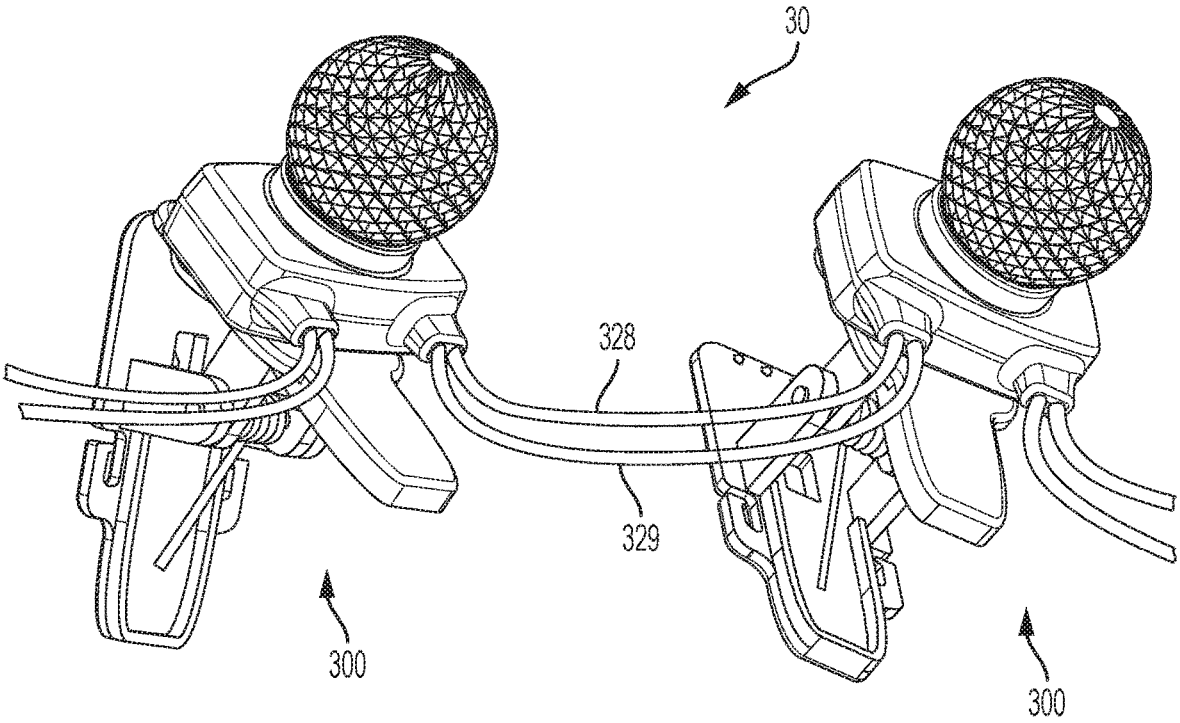
FIG. 14 depicts a string of clip lights in a relaxed state and in an expanded state, according to the third embodiment of the invention.
Figure 15:
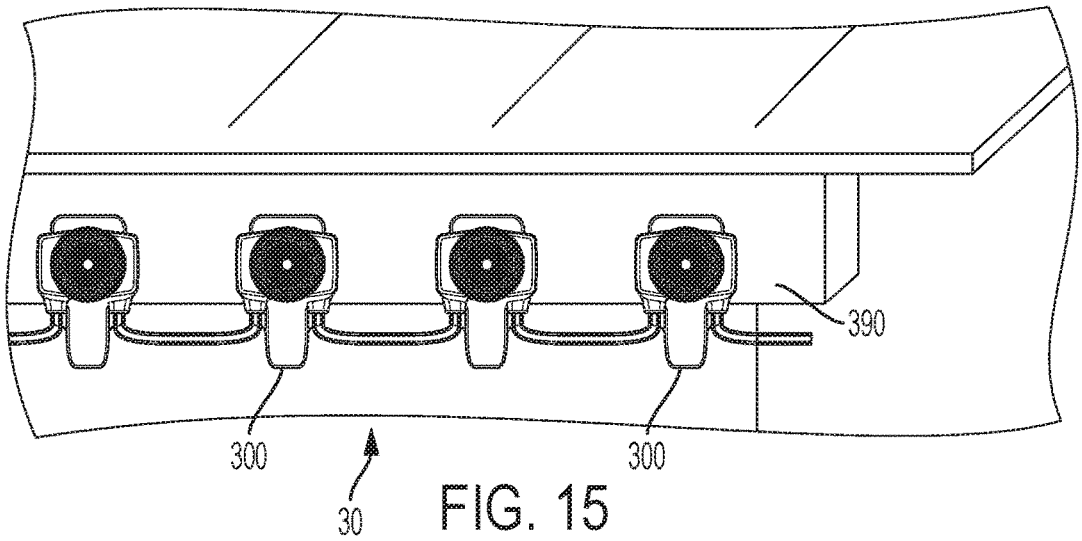
FIG. 15 depicts a front view of a string of clip lights connected to an eaves, according to the third embodiment of the invention.

FIG. 14 depicts a lighting system 30 having clip lights 300 located in varying states. FIG. 14 depicts the clip light 300 being connected by wires 328, 329. FIG. 15 shows the lighting system 30 being mounted to a structure 390, for example, a fascia board on a house.

Figure 16:
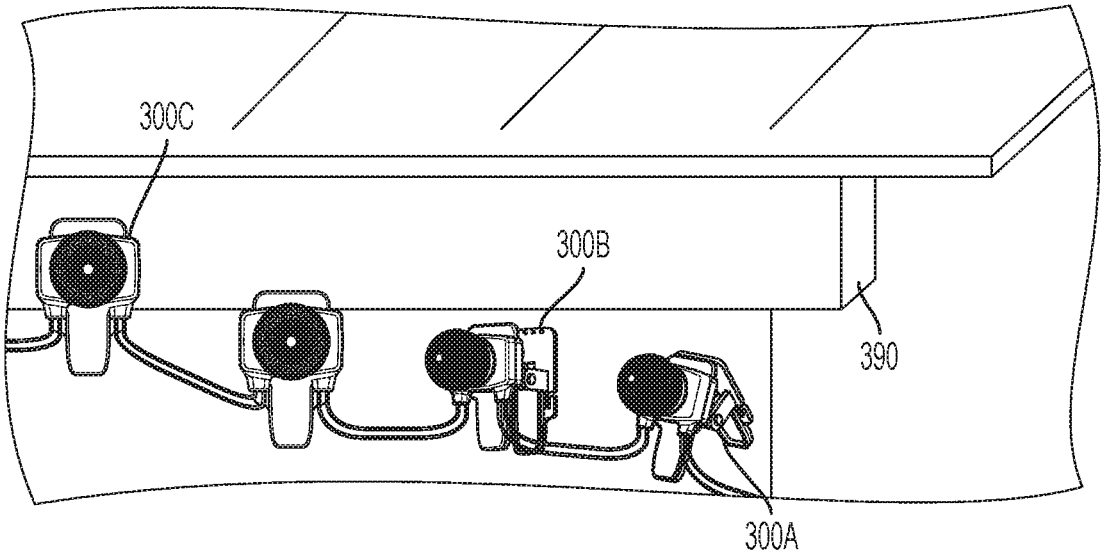
FIG. 16 depicts a perspective view of a string of clip lights being connected to an eaves, according to the third embodiment of the invention.

FIG. 16 shows the varying states of the clip light. Clip light 300A shows the clip light in the relaxed, closed state. Clip light 300B is in the more expanded, opened state. Clip light 300C is shown mounted to the structure 390. As shown, the clip light 300 can illuminate outwardly away from the structure to which it is attached. The clip lights can be configured to be oriented directly away from the structure 390 or at an angle to thus project light at various orientations.

Similar to prior embodiments, a plurality of the clip lights 300 can be connected in a string and operated by a control system. The illumination of the lights can be controlled using a controller that is electrically coupled to the lighting system, using structures and functions similar to those disclosed with reference to the first embodiment.

Fourth Embodiment

Figure 17:
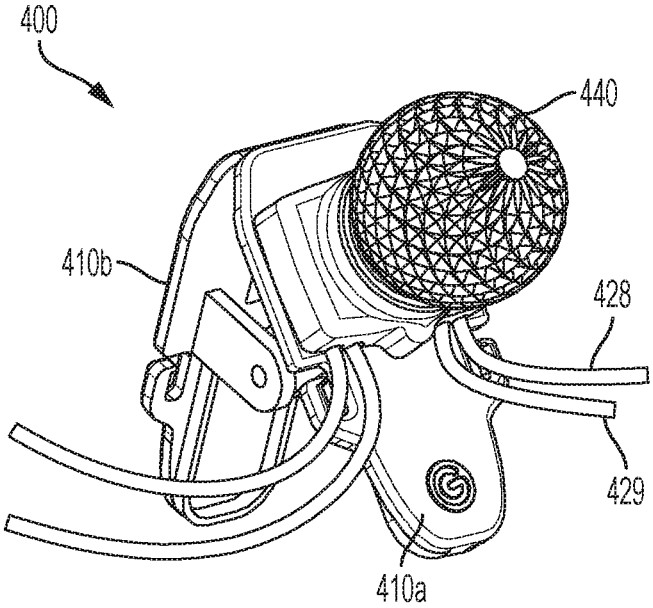
FIG. 17 depicts a perspective view of a clip light, according to a fourth embodiment of the invention.

FIGS. 17-21 depict a fourth embodiment of a clip light 400 according to the present invention. FIG. 17 shows a perspective view of clip light 400. Clip light 400 can have first and second clamp members 410*a*, 410*b* that are connected together in the form of a hinge, and operate in a similar manner as previous embodiments. Wires 428, 429 can proceed in and out of the clip light 400 to supply power and electrical connection. Lens 440, such as a kaleidoscope lens, can illuminate the light from the clip light 400.

Figure 18:
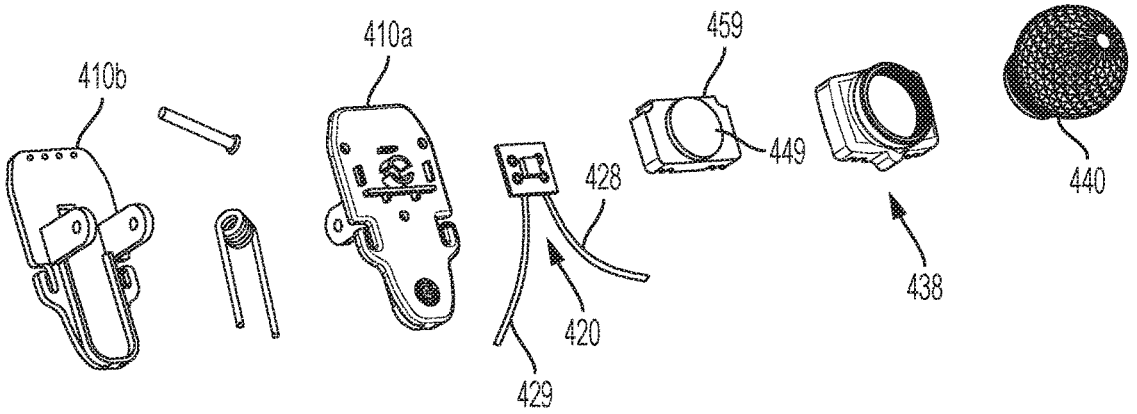
FIG. 18 depicts an exploded view of a clip light, according to the fourth embodiment of the invention.

As shown in FIG. 18, an intermediate light unit cover 459 can be directly mounted onto the exterior surface of the first clamp member 410*a*. In this embodiment, the light unit 420 can be disposed inside the intermediate light unit cover 459 and an upper light unit cover 438 can house the intermediate light unit cover and the light unit 420. The upper light unit cover 459 can be mounted directly onto the exterior surface of the first clamp member 410*a*. Intermediate cover 459 can include an intermediate member 449, which can allow light from the light unit 420 to transmit through. As shown in FIG. 18, the intermediate member 449 can be in the shape of a circle, however, other shapes are possible. The intermediate member 449 can be made of plastic, glass, or other durable but transparent/translucent material. According to embodiments, based on the translucent nature of the intermediate member 449 in some embodiments, light emitted from the light unit 420 can be made more uniformly distributed by passing through the intermediate member 449. Other structural aspects of the clip light 410 can be similar to those described in the third embodiment.

Figure 19:
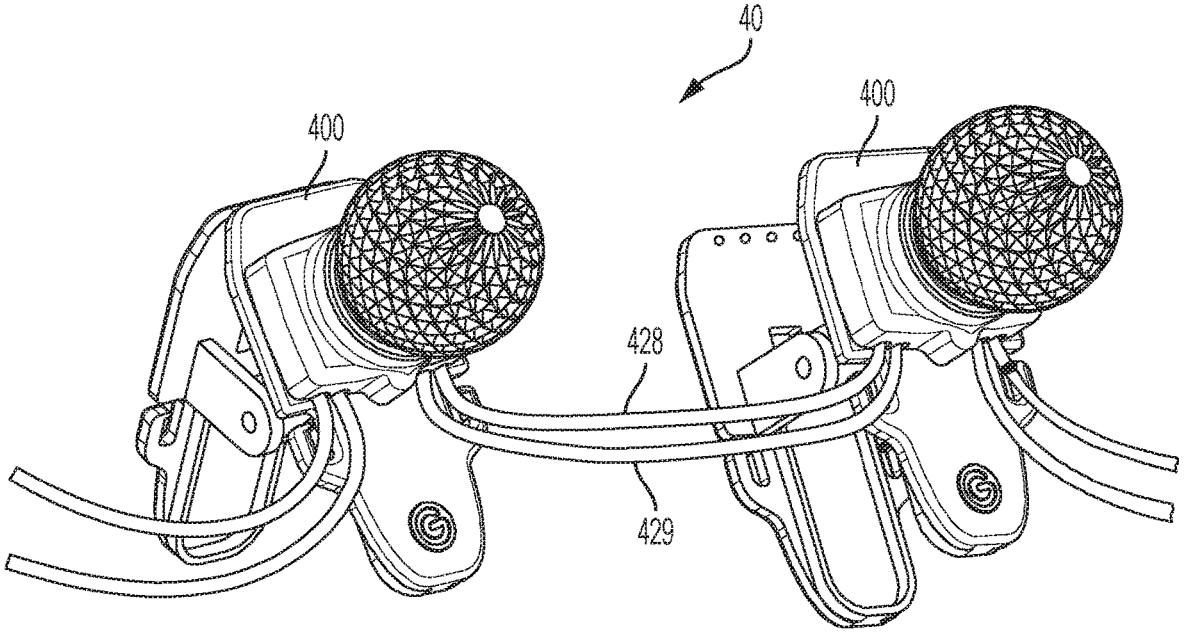
FIG. 19 depicts a perspective view of a string of clip lights in a relaxed state and in an expanded state, according to the fourth embodiment of the invention.
Figure 20:
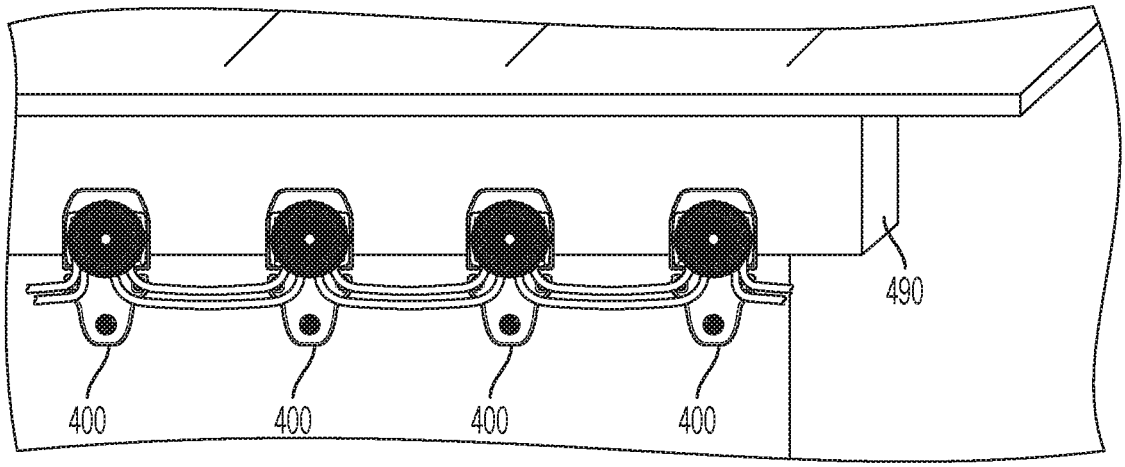
FIG. 20 depicts a front view of a string of clip lights connected to an eaves, according to the fourth embodiment of the invention.
Figure 21:
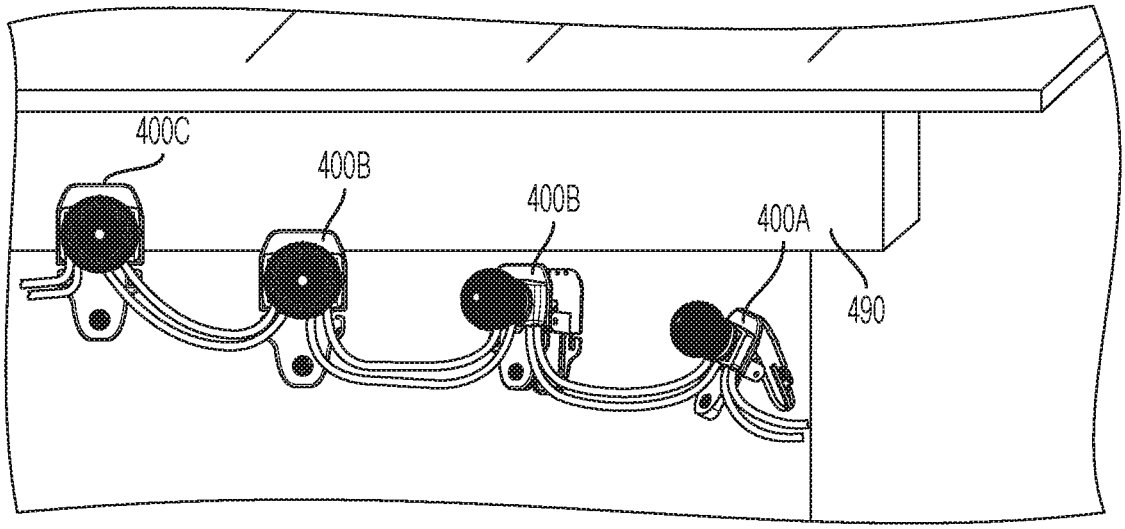
FIG. 21 depicts a perspective view of a string of clip lights being connected to an eaves, according to the fourth embodiment of the invention.

FIG. 19 shows a lighting system 40 including a chain of clip lights 400 connected by wires 428, 429 with one of the clip lights in a closed, relaxed state and one of the clip lights in an open, expanded state. FIG. 20 shows the chain of clip lights 400 mounted to a structure 490, such as a fascia board. FIG. 21 shows a progression of the state of the clip lights with clip light 400A being in a relaxed, closed state, clip lights 400B being in a more open, more expanded state, and clip light 400C being in a mounted state. Other features and aspects of clip light 400 can be the same or substantially the same as clip light 300 from the third embodiment.

Fifth Embodiment

Figure 22:
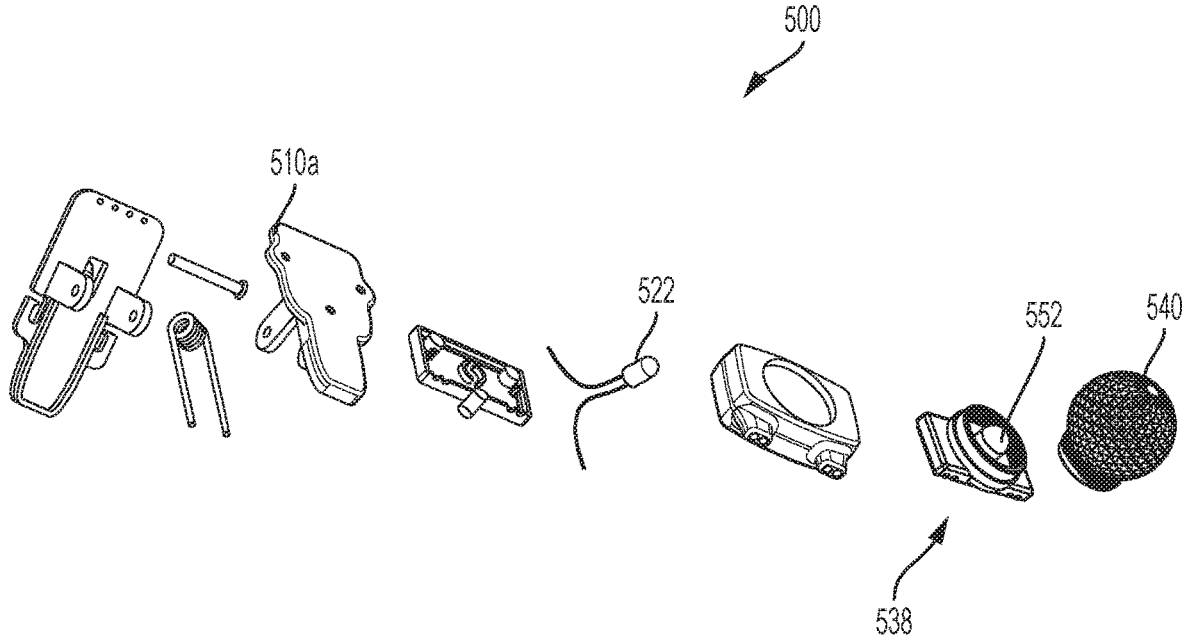
FIG. 22 depicts an exploded view of a clip light, according to a fifth embodiment of the invention.

FIG. 22 shows an embodiment of a clip light 500 that is similar to the third embodiment except for the differences described herein. In FIG. 22, the light unit 520 can include a capsule-shaped LED 522 rather than a surface mounted LED. The capsule-shaped LED 522 can protrude orthogonal to and upwards from the surface of the clamp member 510*a*. The capsule-shaped LED 522 can extend into a receptacle 552 provided in the upper light unit cover 538 for receiving the capsule-shaped LED 522. The receptacle 552 can be transparent or translucent, and allow for distribution of light throughout the lens 540, which can comprise a beam-splitting kaleidoscope lens. Alternatively, the capsule-shaped LED 522 can shine directly into the lens 540. According to embodiments, the upper light unit cover 538 and receptacle 552 can be made of colorful materials, such as colored plastic, glass, or other materials, that changes the light emitted from light unit 520.

Sixth Embodiment

Figure 23:
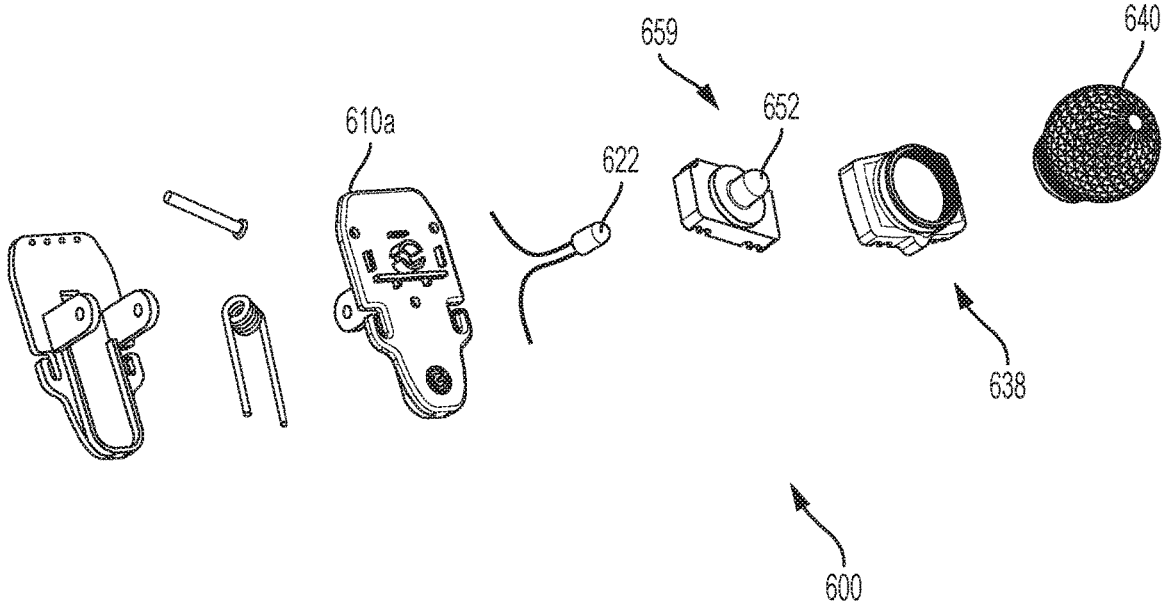
FIG. 23 depicts an exploded view of a clip light, according to a sixth embodiment of the invention.

FIG. 23 shows a sixth embodiment of a clip light 600 that is similar to the clip light of the fourth embodiment, except as described hereinafter. Here, the clip light 600 can include a capsule-shaped LED 622 that is configured to stand upright inside the light unit covers. An intermediate light unit cover 659 can include a receptacle 652 that is configured to receive the capsule-shaped LED 622. This can allow for the light to be distributed to the lens 640, which can comprise a beam splitting kaleidoscope lens. The intermediate light unit cover 659 can be housed inside the upper light unit cover 638. The intermediate unit cover 659 can be directly mounted to the first clamp member 610*a* underneath the upper light unit cover 638. According to embodiments, the upper light unit cover 638 and receptacle 652 can be made of colorful materials, such as colored plastic, glass, or other materials, that changes the light emitted from light unit 520.

Seventh Embodiment

Figure 24:
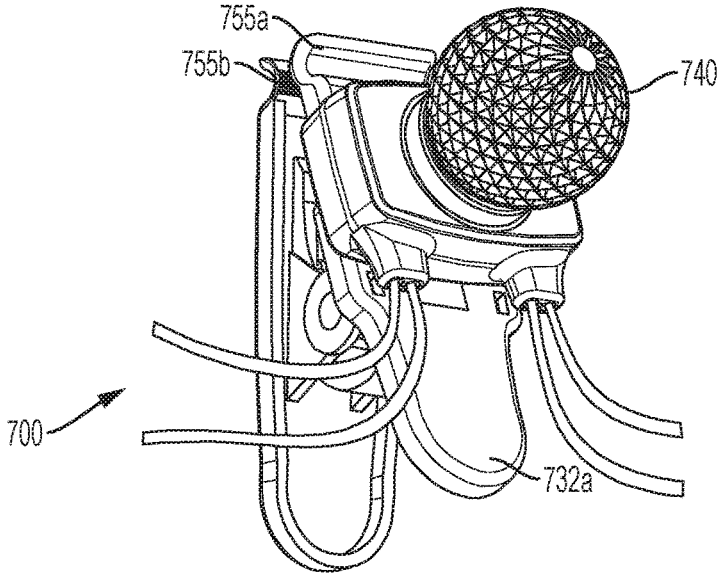
FIG. 24 depicts a perspective view of a clip light, according to a seventh embodiment of the invention.
Figure 25:
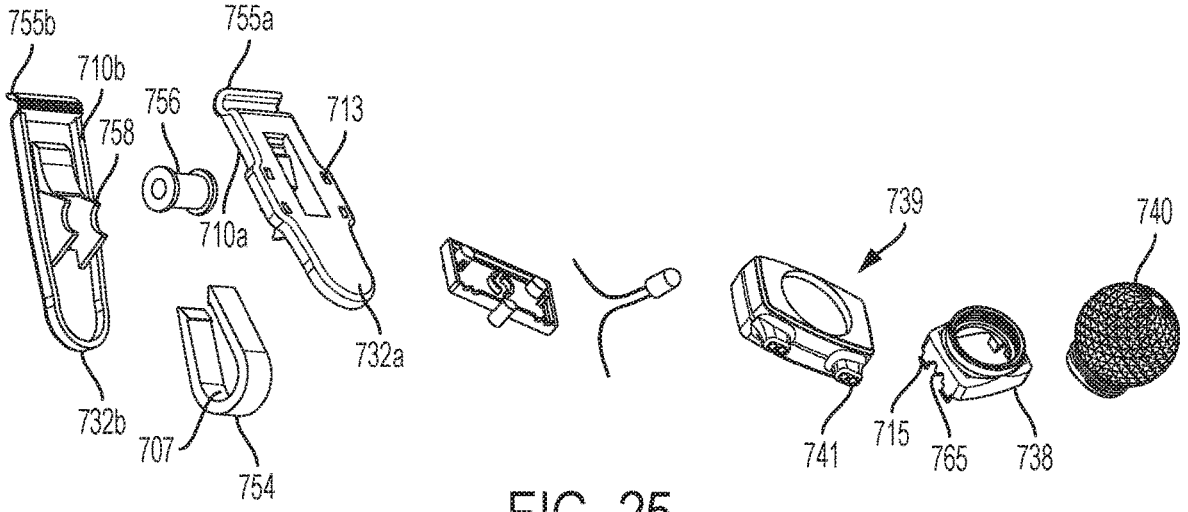
FIG. 25 depicts an exploded view of a clip light, according to the seventh embodiment of the invention.
Figure 26:
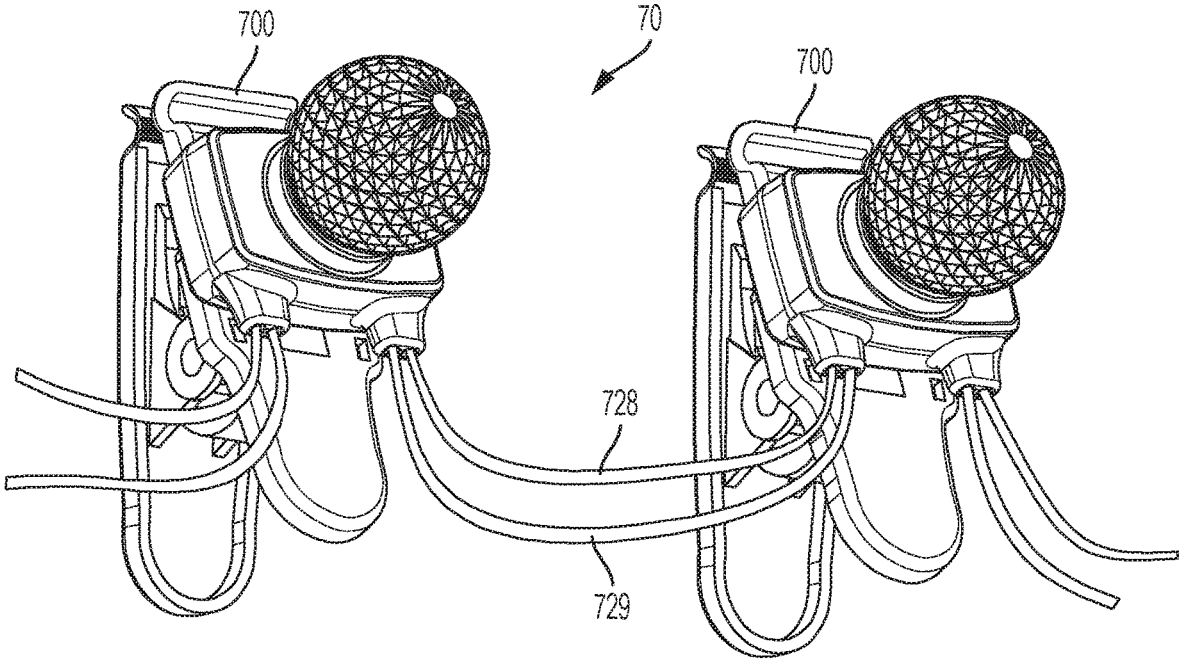
FIG. 26 depicts a perspective view of a string of clip lights, according to the seventh embodiment of the invention.
Figure 27:
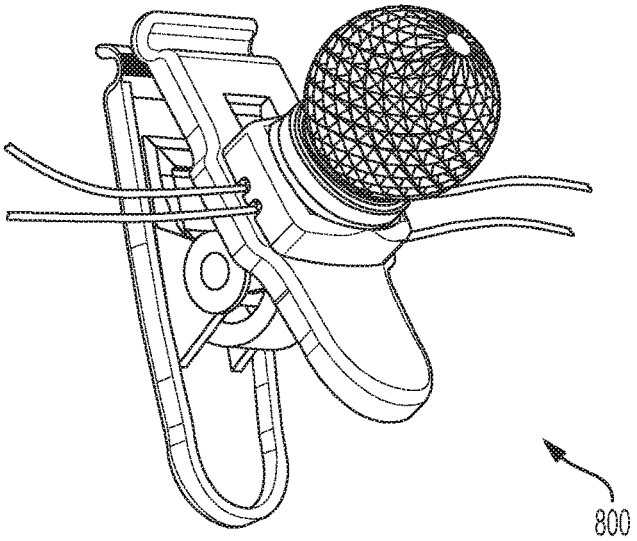
FIG. 27 depicts a perspective view of a clip light, according to an eighth embodiment of the invention.

FIGS. 24-26 show a perspective view of a clip light 700 according to a seventh embodiment of the invention. As can be seen from the exploded view in FIG. 25, some components are similar to the fifth embodiment. Here, the first and second clamp members 710*a*, 710*b* can be shaped to interface with a dowel pin 756. That is, the first and second clamp members 710*a*, 710*b* can each include raised ridges 758 (hidden from view for clamp member 710*a*) that outline a partially circular cross-section. The raised ridges can interface with and allow for pivoting of the clamp members 710*a*, 710*b* about the dowel pin 756. A resilient spring clip 754 can bias the two clamp members 710*a*, 710*b* towards each other. The spring clip 754 can receive the dowel pin 756 in a central space 707 of the spring clip 754. While the dowel pin 756 is in the central space of the spring clip 754, opposing end portions of the dowel pin can engage within pockets (hidden for clamp member 710*a*) formed under the raised ridges 758 to bias the ends 755*a*, 755*b* of the clamp members 710*a*, 710*b* towards one another. At the same time, the exterior surface of the spring clip 754 can abut against the interior surface of the first and second clamp members 710*a*, 710*b* and can be configured to push against the interior surface of the first and second clamp members 710*a*, 710*b*. Pressure applied to the bottom portions 732*a*, 732*b* of the first and second clamp members 710*a*, 710*b* (e.g., by a user's fingers) can cause the spring clip 754 to resiliently move into an open state. In this configuration, pressure applied towards end portions 732*a*, 732*b* opens up the spring clip 754, and the configuration of the spring clip 754 will bias the first and second clamp members 710*a*, 710*b* back to its resting state. The ends 755*a*, 755*b* of the first and second clamp members 710*a*, 710*b* can each define outwardly curved surfaces, as shown in FIG. 24. Ridges or other friction-enhancing surfaces can be provided on the interior-facing surfaces of these ends 755*a*, 755*b*.

Clamp members 710*a*, 710*b* can be made of plastic, metal, composite, wood or any other durable material. The spring clip 754 can be made of plastic (including hard plastic), rubber, metal, composite or any other resilient yet flexible material that allows for the opening of the spring clip 754. The dowel pin 756 can be made of plastic, metal, composite, wood or any other resilient material that is configured to withstand and distribute pressure.

Light unit cover 738 can include snaps 715 that are configured to fit into notches 713 on the exterior surface of first clamp member 710*b*. The snaps 715 can snap into or otherwise engage with the notches 713 for a solid, durable fit. As shown in FIG. 25, the kaleidoscope lens 740 can attach to the light unit cover 738 using mating threads.

Also shown in FIG. 25 is that the upper light unit cover 738 can outline grooves 765 on a side of the cover to allow for wires to extend therethrough. The exterior housing 739 can still have the wire adapters 741 outline holes at the bottom to facilitate the wires entering and exiting the clip from the bottom of the clip. Thus, as shown in FIG. 26, a lighting system 70 can include a string of clip lights 700 can be connected by wires 728, 729. The operation and control of the clip lights 700, and related structures, can be similar to the description provided for the first embodiment.

Eighth Embodiment

Figure 28:
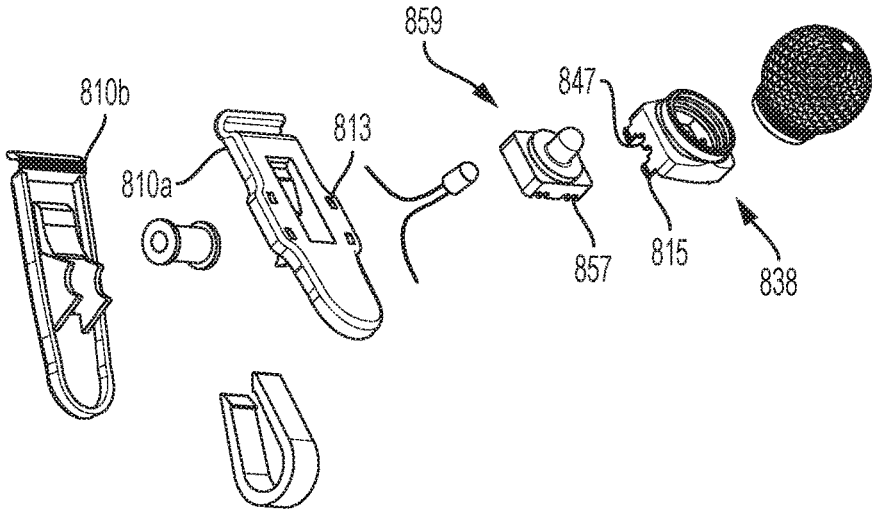
FIG. 28 depicts an exploded view of a clip light, according to the eighth embodiment of the invention.

FIGS. 27-31 show a perspective view of a clip light 800 according to an embodiment that is similar to the clip light 700 of the seventh embodiment, except as described herein below. As shown in FIG. 28, the light unit cover 838 can be directly connected to the first clamp member 810*a*, as described with some earlier embodiments. The intermediate light unit cover 859 can define grooves 857 for wires to extend through the bottom of the cover. The light unit cover 838 can define grooves 847 located in registry with the grooves 857 of the first upper light unit cover 859. In this manner, wires 828, 829 exiting and entering the light unit covers can do so at the side of the clip light. Light unit cover 838 can include snaps 815 that are configured to fit into notches 813 on the exterior surface of first clamp member 810*a*. The snaps 815 can snap into or otherwise interface with the notches 813 for a solid, durable fit.

Figure 29:
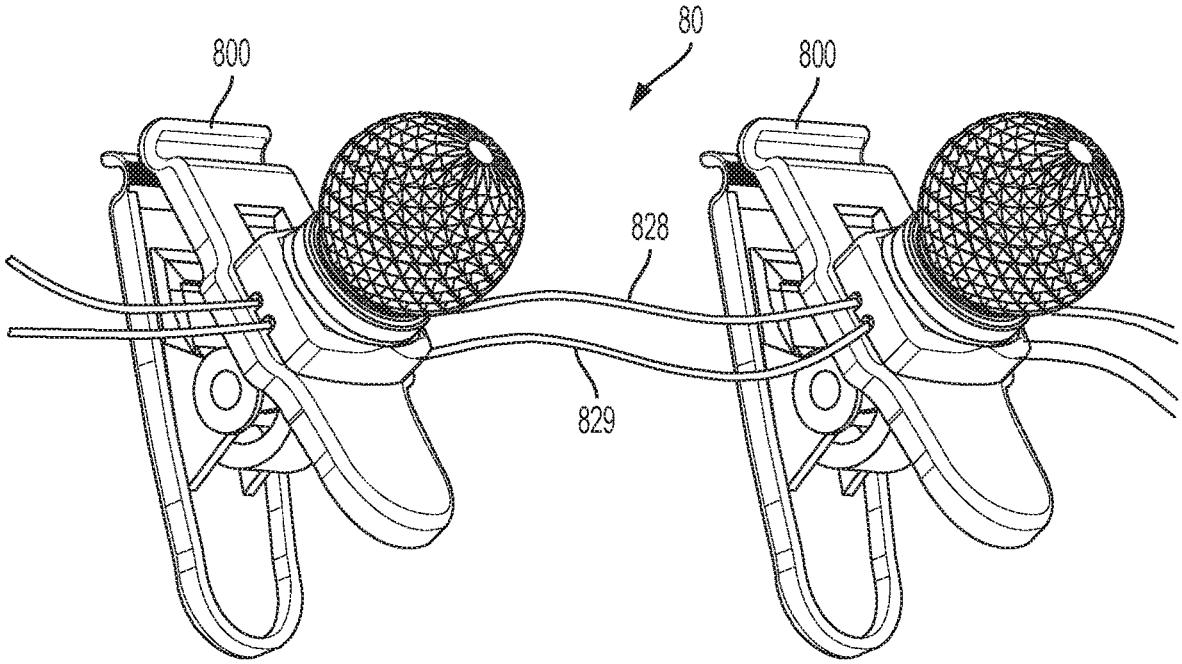
FIG. 29 depicts a perspective view of a string of clip lights, according to the eighth embodiment of the invention.
Figure 30:
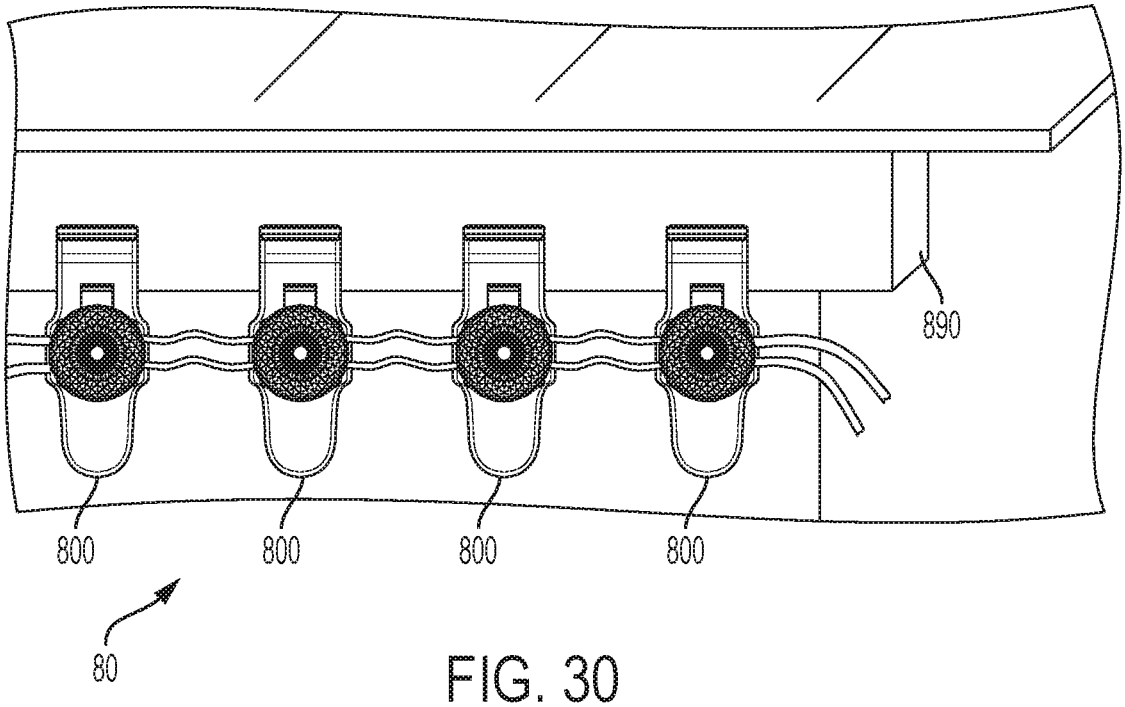
FIG. 30 depicts a front view of a string of clip lights connected to an eaves, according to the eighth embodiment of the invention.
Figure 31:
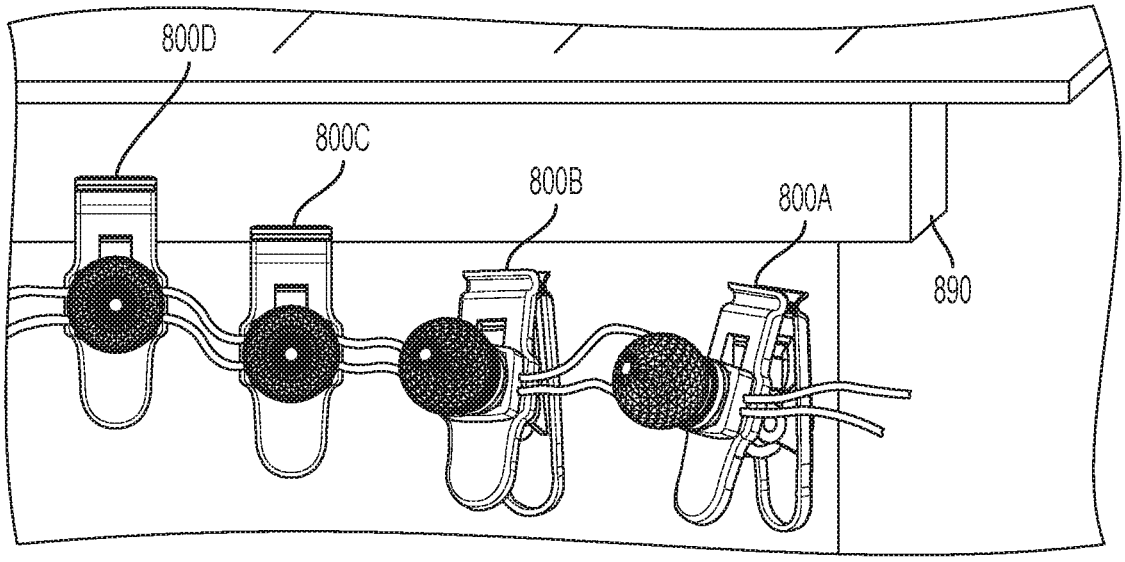
FIG. 31 depicts a perspective view of a string of clip lights being connected to an eaves, according to the eighth embodiment of the invention.

FIG. 29 depicts a lighting system 80 comprising two clip lights 800 connected by wires 828, 829, similar to previous embodiments. FIG. 30 shows a string of clip lights mounted to a structure 890, according to the eighth embodiment of the invention. FIG. 31 shows various stages of the clip lights in mounting to the structure, with clip lights 800A and 800B being shown in a closed, relaxed state, clip light 800C being shown in a more open, expanded state, and clip light 800D being shown in a mounted state.

Ninth Embodiment

Figure 32:
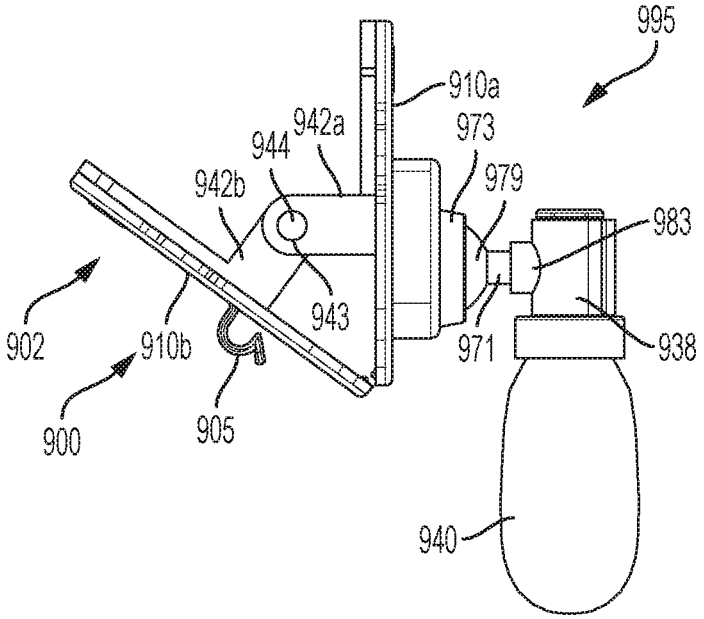
FIG. 32 depicts a side view of a clip light, according to a ninth embodiment of the invention.

FIGS. 32-37 depict a clip light 900 according to a ninth embodiment of the invention. The clip light 900 can include an articulating joint that allows the orientation of the light unit to be adjusted with respect to the clip, for example, to provide flexibility in placement of the clip. FIG. 32 shows a side view of the clip light 900. As shown, the clip light 900 can include a clip 902 that can include clamp members 910*a*, 910*b* having extension arms 942*a*, 942*b*, respectively. Each extension arm 942*a*, 942*b* can define a hole 943 for receipt of a pin 944. The pin 944 can form a hinge between the clamp members 910*a*, 910*b*, similar to some of the previously-described embodiments. The clamp members 910*a*, 910*b* can be biased toward each other by means of a spring (not shown) or other elastic member disposed in between the two members (see, e.g., FIGS. 22-23) or in another way.

Clamp members 910*a*, 910*b* can be made of plastic, metal, composite, wood, or any other durable material. The arms 942*a*, 942*b* can be made of plastic (including hard plastic), rubber, metal, composite, wood, or any other durable material. The pin 944 can be made of hard plastic, metal, composite, or other material that is configured to withstand and distribute pressure.

Figure 34:
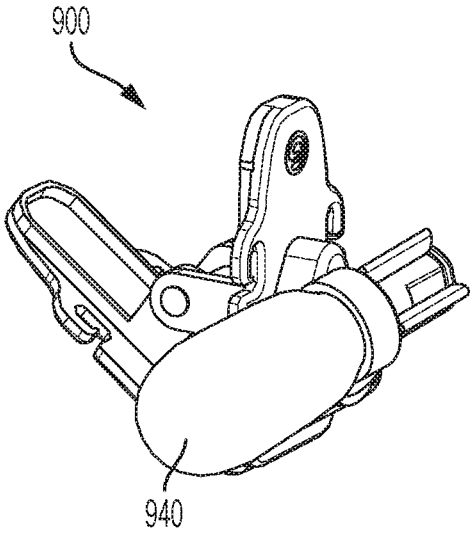
FIG. 34 depicts a perspective view of a clip light with a rotated light, according to the ninth embodiment, shown with the light rotated into a different position than FIGS. 32 and 33.
Figure 35:
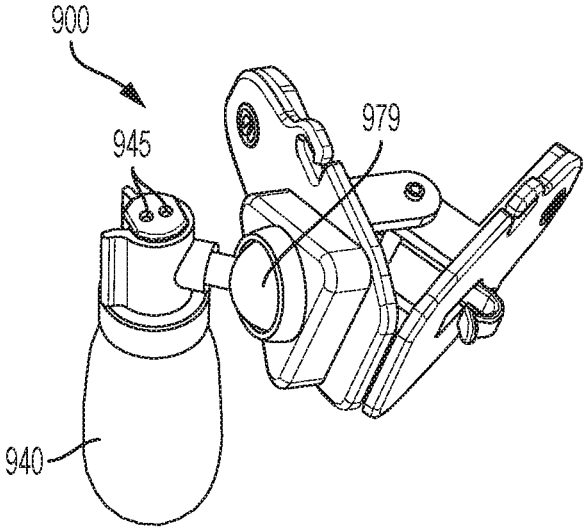
FIG. 35 depicts a bottom-right perspective view of FIG. 34.
Figure 36:
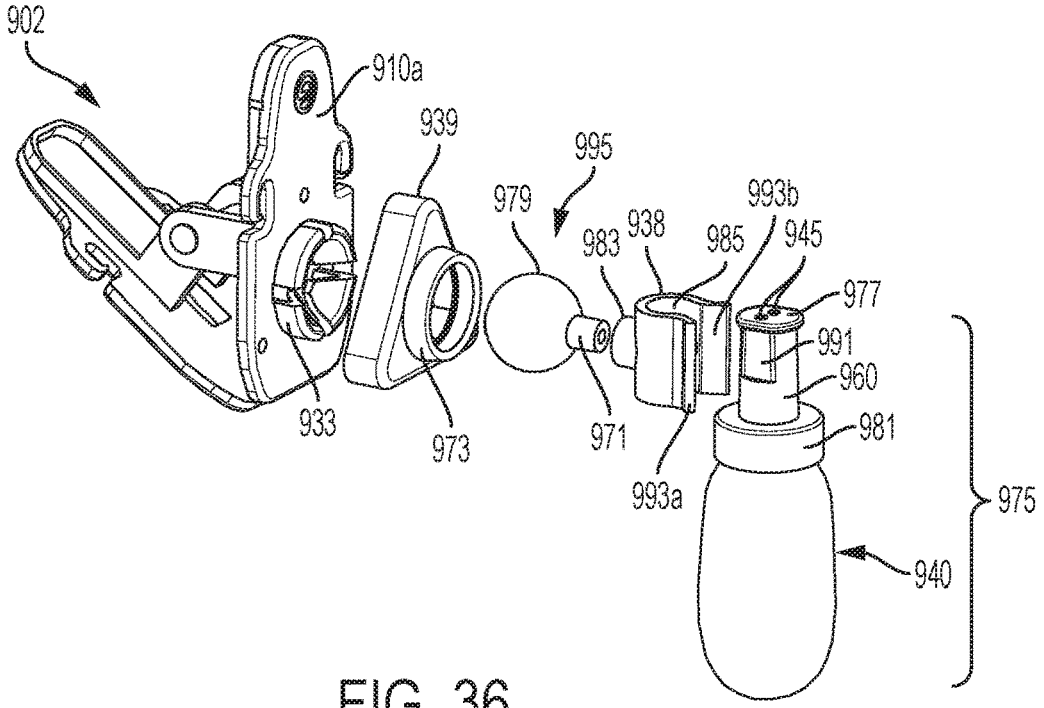
FIG. 36 depicts an exploded view of the clip light of FIG. 32.

As shown in FIG. 32, the clip light 900 can include an articulating joint 995 between the clip 902 and the lens 940. The joint 995 can allow the lens 940 to rotate about multiple axes with respect to the clip 902, as depicted in FIGS. 34 and 35. With reference to FIG. 36, the joint 995 can include a ball head 979 that mates with a socket defined by a receiving cavity 933 in the first clamp member 910*a*, and a cover 939 that attaches to the first clamp member 910*a* over the cavity 933. The cover 939 can attach to the first clamp member 910*a* using mating pins and cavities, as shown, or alternatively, using other known techniques including adhesives and/or fasteners. The cavity 933 can include reliefs that allow the cavity 933 to flex under the application of pressure, for example, from the ball head 979.

A connecting portion 971, for example, in the shape of a cylindrical boss, can extend from the ball head 979. The connecting portion 971 can extend through a flange 973 on the cover 939. The flange 973 can engage the connecting portion 971 to limit the range of motion of the ball head 979 within the socket.

The clip light 900 can include a snap collar 938 having a flange 983 that engages with the connecting portion 971 of the ball head 979, for example, in a manner that allows the snap collar 938 to pivot with respect to the ball head 979 about the connecting portion 971/flange 983. The snap collar 938 can define a cavity 985 that is configured to resiliently engage and secure a portion of the light unit 975. The cavity can be defined as a cylindrical channel with an open lateral region, as depicted in FIG. 36, however, other shapes are possible. The components of the rotatable interface member 995 can be made of hard plastic, metal, composite, or other durable materials, and/or combinations thereof. Hooks 917*a*, 917*b* (see FIG. 32) can be disposed on the edge of clamp member 910*b* and hooks 903*a*, 903*b* can be disposed on the edge of clamp member 910*a*. Hook 905 can be disposed in the center of clamp member 910*b* and can protrude away from the exterior surface of the clamp member 910*b*. The hook 905 and hooks 903*a*, 903*b* and 917*a*, 917*b* can be used to manage the placement of the wires.

Still referring to FIG. 36, a lens base 960 can be secured to the translucent or transparent lens 940, for example, by a flange 981. According to embodiments, the lens base 960 can take the shape of a cylinder, however, other shapes are possible. The lens base 960 can also include at least one planar surface 991. The lens base 960 can snap into and resiliently engage within the cavity 985 of the snap collar 938 to releasably connect the lens 940 to the clip 902. According to embodiments, the light unit 975 can be configured to rotate along the axis of the lens base 960 with respect to the snap collar 938. The snap collar 938 can wings 993*a*, 993*b* on either side of the groove to facilitate insertion of the lens base 960 into the cavity 985. The snap collar 938 in some embodiments can be made of a material that has a coefficient of flexibility to allow for the snap collar 938 and/or wings 993*a*, 993*b* to flex to receive the lens base 960 of the light unit 975. According to the embodiments shown, the cover 939 is shaped as a triangle, however, other shapes are possible.

According to embodiments, the snap flange 938 can be configured to receive the lens base 960 in the cavity 985 so that very little or no movement of the light unit 975 relative to the snap collar 938 takes place. As described previously, the lens base 960 can include at least one planar surface 991.

Figure 39:
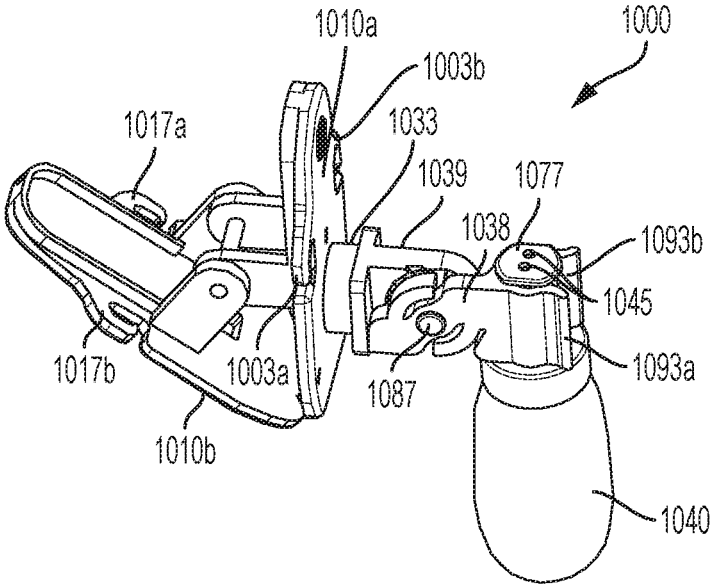
FIG. 39 depicts a perspective view of a clip light, according to the tenth embodiment.

According to embodiments where the lens base 960 has two of the planar surfaces 991 diametrically opposed, the planar surfaces 991 can be aligned with the wings 993*a*, 993*b* to facilitate insertion of the lens base 960 into the cavity 985 by virtue of the width of the lens base 960 (at the planar surfaces) being smaller than the width of the lateral entrance to the cavity 985. The light unit 975 can then be twisted to prevent the lens base 960 from unintentionally exiting the cavity 985. In some embodiments, the lens base 960 can include two planar surfaces 991. In some embodiments, the lamp holder does not have any planar surfaces at all and has a shape of a cylinder. The width of the lens base 960 can be bigger than the lateral entrance to the cavity 985 so as to prevent the lens base 960 from unintentionally exiting the cavity 985. As shown in FIG. 39, the lens base 960 can have a base surface 977 that defines one or more holes 945 for wires 928, 929 to proceed through. The wires 928, 929 can connect with one or more lighting units (hidden from view), such as LEDs, located within the interior of lens 940.

Figure 33:
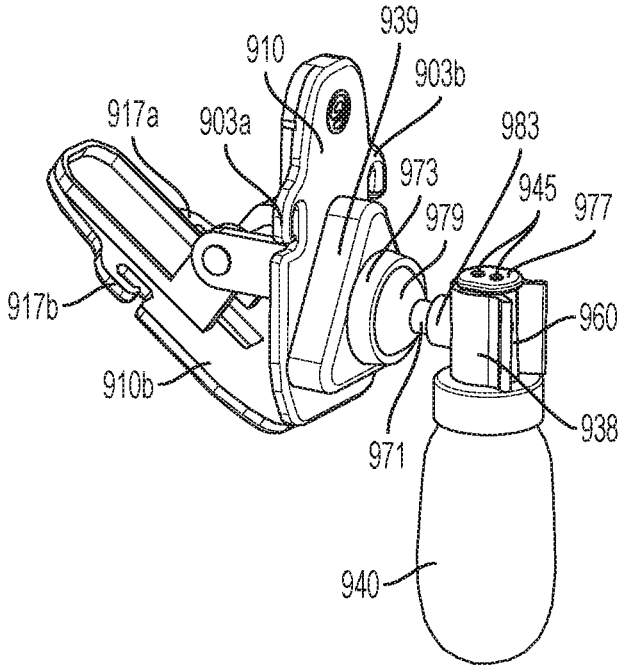
FIG. 33 depicts a perspective view of a clip light, according to the ninth embodiment.

The clip light 900 can allow for two or more degrees of movement of the light unit 975 relative to the clip 902, which can remain stationary while the light unit 975 moves. According to embodiments, the light unit 975 can rotate in a substantially spherical range of movement due to movement of the ball head 979 with the socket defined on the clip 902. According to embodiments, the light unit 975 can also rotate about the axis of shaft portion 971. FIG. 33 shows the clip light 900 with the shaft portion 971 oriented substantially perpendicularly to the first clamp member 910*a*. FIG. 33 also shows the lens base 960 oriented substantially parallel to the first clamp member 910*a*. Accordingly, the lens 940 extends straight out and downward from the first clamp member 910*a*. FIG. 34 shows the lens 940 after being rotated upward about the axis of the shaft portion 971 by about 90 degrees. FIG. 35 depicts the clip light 900 after the lens 940 has been further rotated upwards about the ball head 979.

Figure 37:
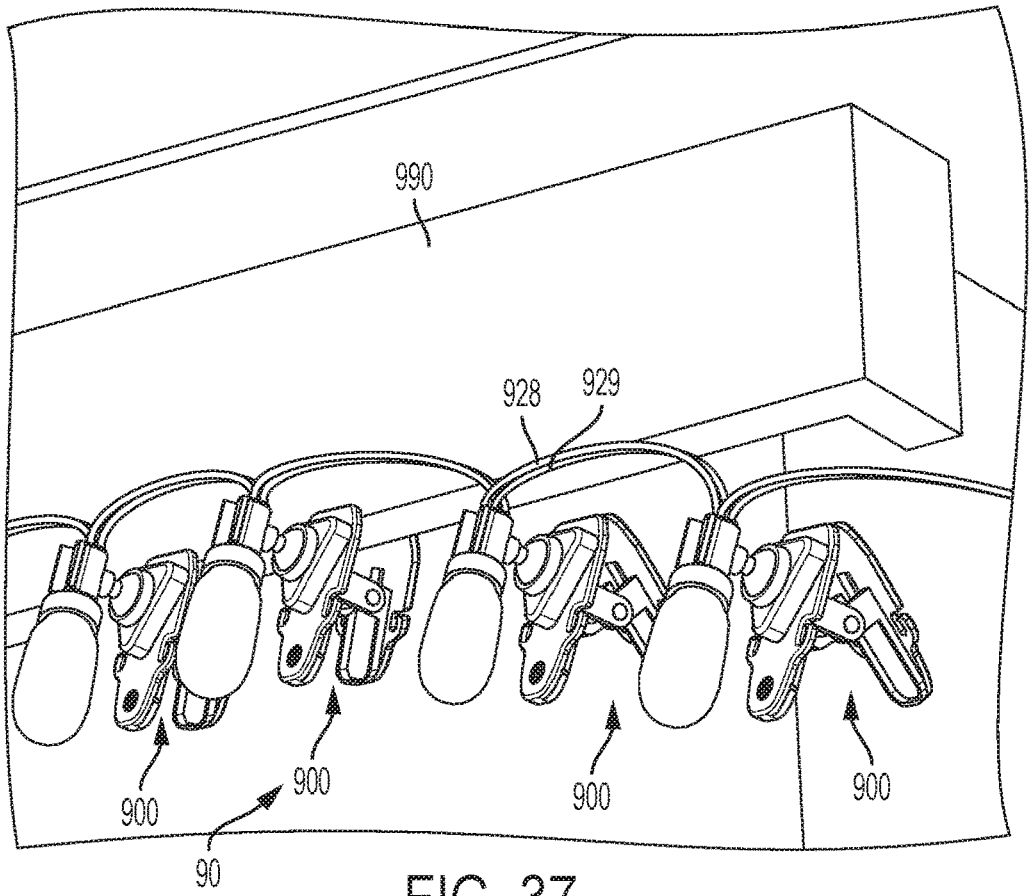
FIG. 37 depicts a perspective view of a string of clip lights being connected to an eaves, according to the ninth embodiment.
Figure 38:
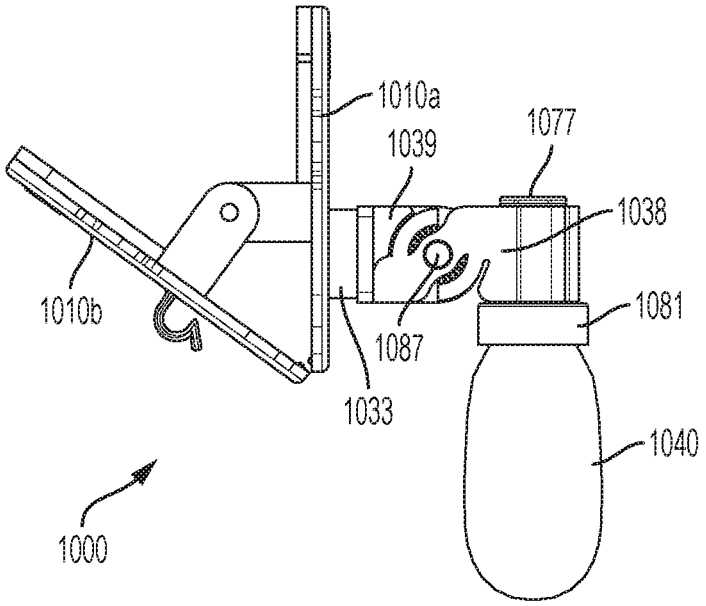
FIG. 38 depicts a side view of a clip light, according to a tenth embodiment of the invention.

FIG. 37 shows a lighting system 90 including a string of clip lights 900 in various stages of attachment to a structure 990. Wires 928, 929 can connect the clip lights 900. The lens 940 on each clip light 900 can be oriented in different directions, which can be convenient for users to provide flexibility in mounting the clips 902 and/or in orienting the lamp bodies 940 in various directions. The illumination of the lights can be controlled using a controller that is electrically coupled to the lighting system, using structures and functions similar to those disclosed with reference to the first embodiment.

Tenth Embodiment

FIGS. 38-43 show an embodiment of a clip light 1000 similar to the ninth embodiment shown in FIGS. 32-37, except that the clip light of FIGS. 38-43 includes a rotatable joint 1039 instead of a ball head. Referring to the exploded view of FIG. 42, clip light 1000 can include a rotatable interface member 1039 having a shaft 1095 (e.g., a cylindrical shaft) on a first end and a toothed engaging portion 1089 on an opposing end. The clip light 1000 can include a snap collar 1038 defining a cavity 1085 with wings 1093*a*, 1093*b*, similar to the ninth embodiment. The snap collar 1038 can further include its own toothed engaging portion (hidden from view) that is configured to mate with and engage the toothed engaging portion 1089 of the rotatable interface member 1039 at multiple angular orientations of the snap collar 1038 and shaft 1095. The light unit connector 1038 can define a cavity 1085 that is configured to engage with a portion of the light unit 1075, as in previous embodiments.

As with the previous embodiment, the light unit 1075 can include a lens base 1060 at the proximal end having at least one planar surface 1091. The lens base 1060 can releasably snap into the cavity 1085 of the snap collar 1038 as with the prior embodiment. The lens 1040 can be joined to the lens base 1060 using, for example, flange 1081, however, other configurations are possible.

The rotatable interface member 1039 can be connected to the first clamp member 1010*a* via a receiving portion 1033 formed on the first clamp member 1010*a*. The receiving portion can define a bore that receives and engages the shaft 1095 of the interface member 1039. In such a configuration, the interface member 1039 can pivot about shaft 1095 with respect to the clip 1002, providing adjustability for the position of lens 1040 with respect to the clip 1002. This adjustability can be seen, for example, in FIGS. 40-41 as the lens 1040 is oriented in a different direction from FIGS. 38-39.

According to embodiments, the light unit 1075 can rotate about multiple axes with respect to the clip 1002. For example, the light unit 1075 can rotate about shaft 1095 with respect to the clip 1002. The interface member 1039 can provide additional degrees of rotation. As mentioned previously, and with reference to FIG. 42, the interface member 1039 can have a toothed engaging portion 1089 that can engage with the connector body 1038. In some embodiments, the engaging portion 1089 can engage with the connector body 1038 through a corresponding toothed engaging portion (hidden) that is complementary in shape to the engaging portion 1089. Each engaging portion can be a substantially circular fan-shape interface comprising a plurality of radially-extending ridges and valleys on the surface. One of the engaging portions can be positioned in mating engagement with the other engaging portion and tightened by either a threaded fastener 1087, a spring-biased pin joint, or other structure known in the art. The ridges and valleys when engaged can prevent rotation of the two interfaces with respect to one another, thereby substantially fixing the angular position of the connector body 1038 with respect to the clip 1002. According to embodiments, the engaging portion 1089 and/or the toothed engaging portion of the connector body 1038 can be formed of a material having sufficient elasticity to allow a predetermined level of force applied to connector body 1038 to move the teeth past one another, to provide adjustment of the angular orientation of the light unit 1075. Each of the grooves around the engaging portion 1089 can allow for the connector body 1038 to lock into the desired angular orientation. Having many of the grooves allows for slight rotations for precise adjustment of the position of the light unit 1075. While the engaging portions in some embodiments can have a circular fan-shaped surface, any shaped surface that provides rotational resistance between the two pieces is contemplated within the broad inventive principles disclosed herein, including, for example, surfaces that are roughened to provide increased frictional engagement.

Figure 42:
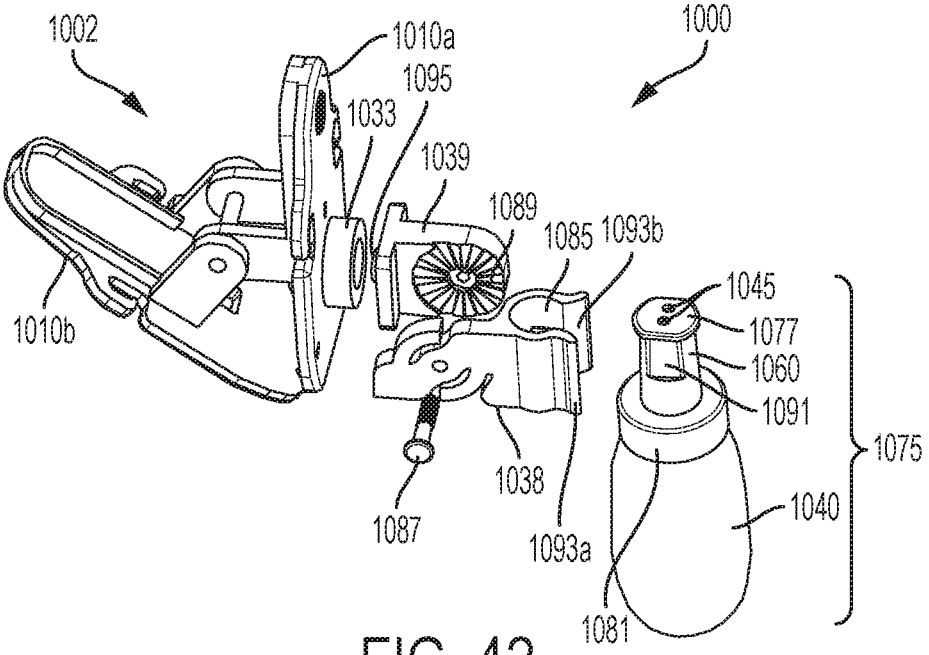
FIG. 42 depicts an exploded view of the clip light of FIG. 38.

As shown in FIG. 42, the lens base 1060 can have a base surface 1077 that defines one or more holes 1045 for wires 1028, 1029 to proceed through. The wires 1028, 1029 can connect to one or more light units (not shown), such as LEDs, located within the lens 1040.

Figure 40:
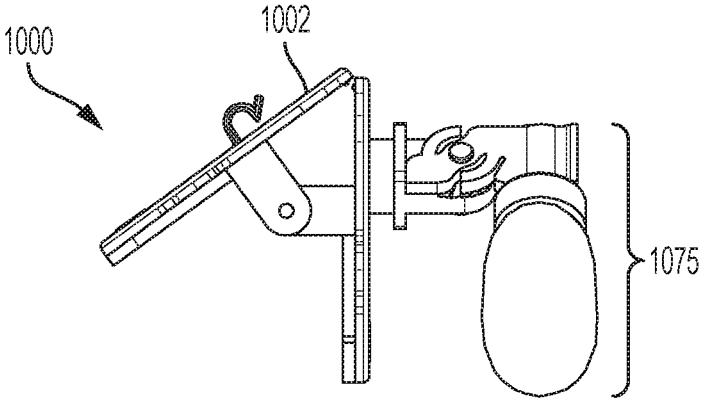
FIG. 40 depicts a side view of a clip light, according to the tenth embodiment, shown with the light rotated into a different position than FIGS. 38 and 39.
Figure 41:
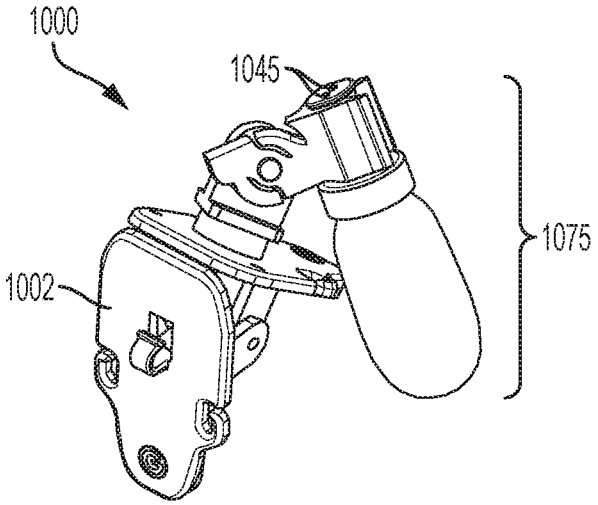
FIG. 41 depicts a bottom-right perspective view of FIG. 40.
Figure 43A:
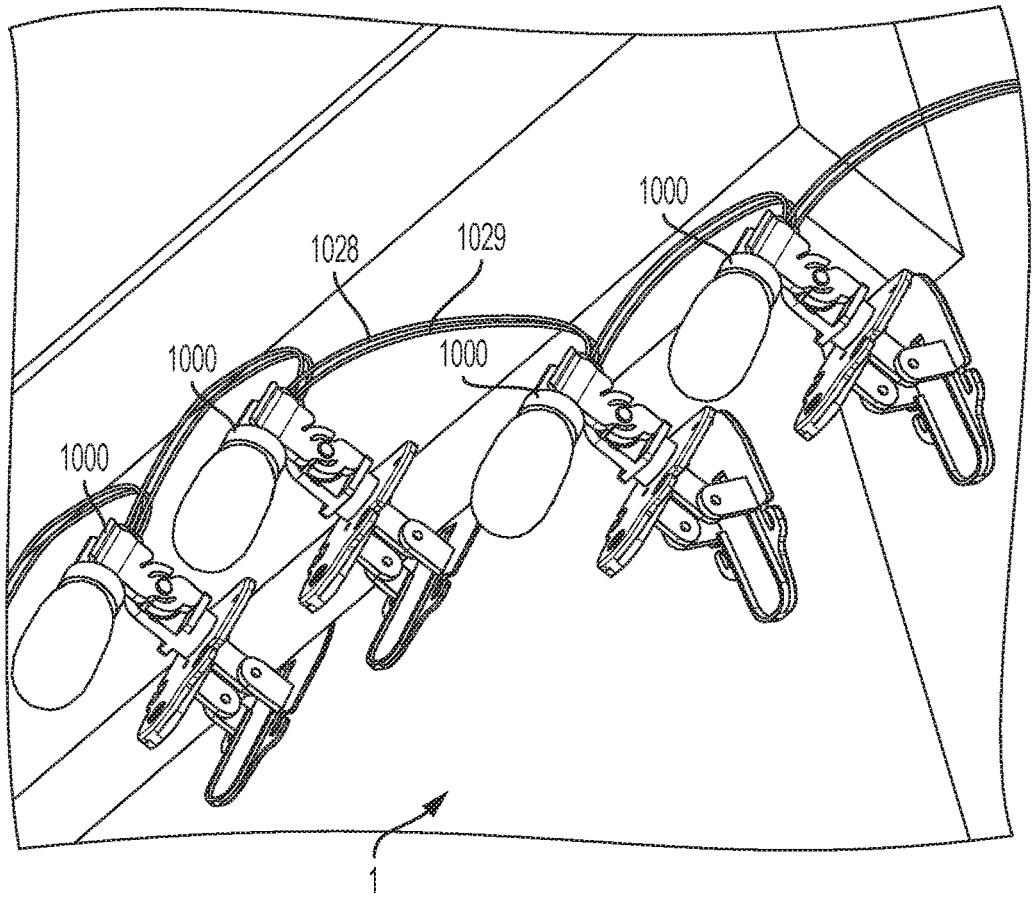
FIG. 43A depicts a perspective view of a string of clip lights being attached to an eaves, according to the tenth embodiment.

FIG. 43A shows a lighting system 1 including a string of clip lights 1000 attached to a structure, such as a home, for example, using wires 1028, 1029. The clip lights can be operated using similar structures and functions as described in connection with prior embodiments. The electronics and light components can be disposed inside the base 1060 of the light unit 1075. FIGS. 40 and 41 depict the clip light 1000 with the light unit 1075 oriented in various different orientations with respect to the clip 102.

Figure 43B:
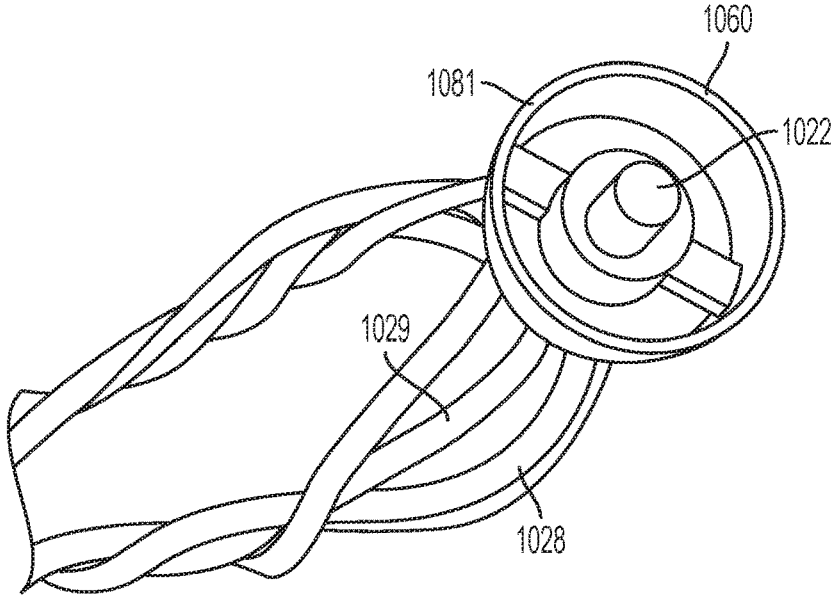
FIG. 43B depicts a perspective view of a portion of a clip light with the lens removed to reveal internal components, according to the tenth embodiment.

FIG. 43B shows a perspective view of the light unit 1075 with the lens 1040 removed from the lens base 1060. As shown, the light 1022 can be an LED, such as an encapsulated LED, housed within the lens base 1060. Any associated electronics (such as a circuit board) can also be located in the lens base 1060. Wires 1028, 1029 can extend into the base 1060, for example, through holes 1045. The illumination of the lights can be controlled using a controller that is electrically coupled to the lighting system, using structures and functions similar to those disclosed with reference to the first embodiment.

Eleventh Embodiment

FIGS. 44-49 show a clip light 1100 having a similar configuration to the ninth embodiment clip light with a difference being that the releasably engageable snap collar 938 and lens base 960 are replaced with a fixed lamp cover 1177*a*, 1177*b*. Additionally, the lens 940 of the ninth embodiment is replaced with a lens 1140, which, as shown, can be designed to resemble an icicle.

Figure 47B:
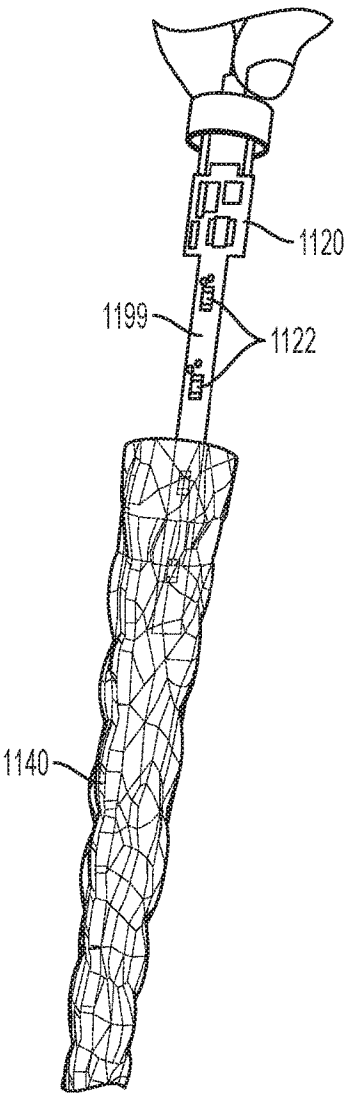
FIG. 47B depicts another exploded view of the clip light of FIG. 44.
Figure 47A:
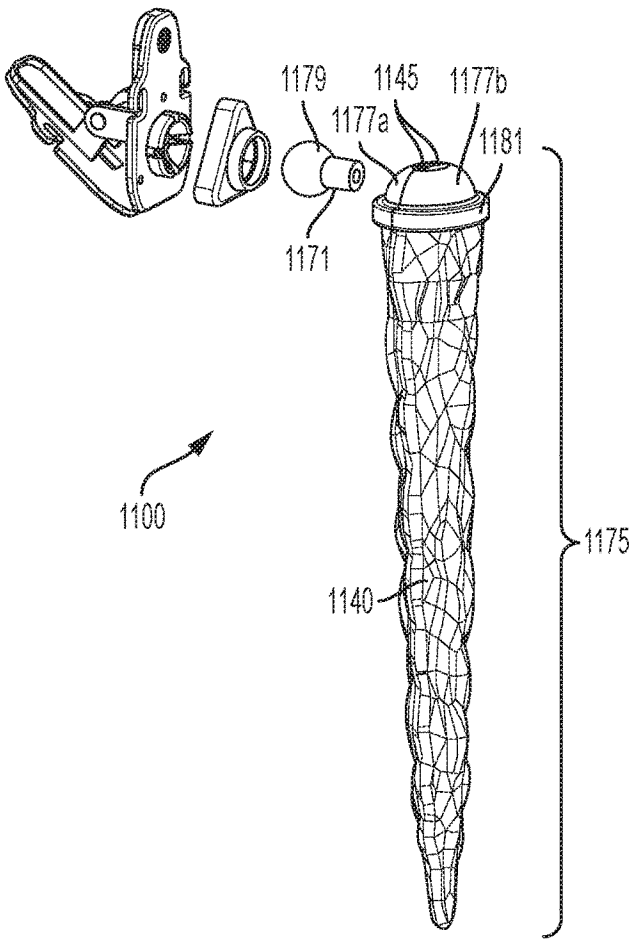
FIG. 47A depicts an exploded view of the clip light of FIG. 44.
Figure 48:
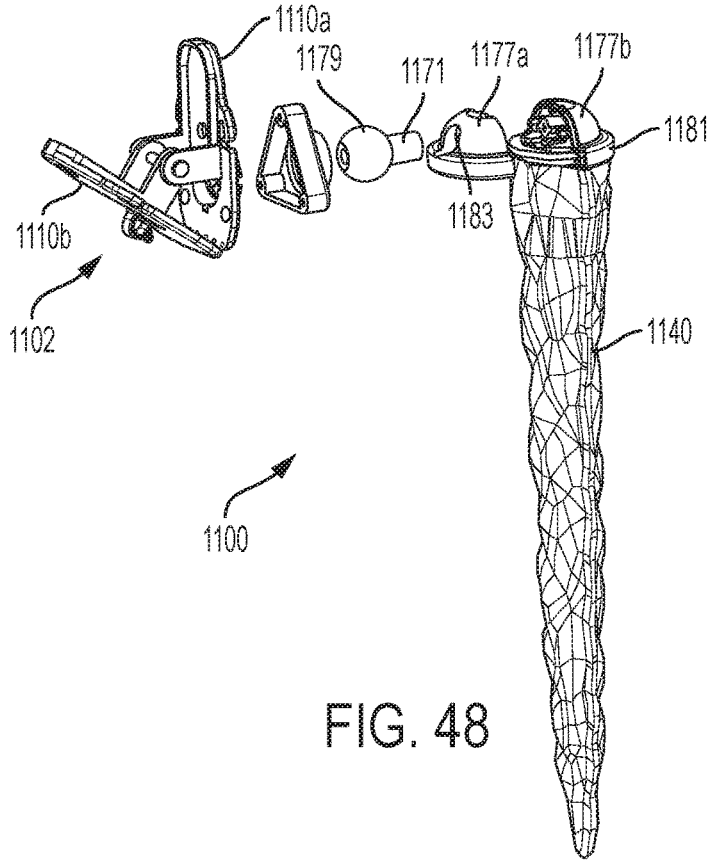
FIG. 48 depicts an opposing view of FIG. 47A.

Similar to the ninth embodiment, and as shown in FIGS. 47A and 48, the clip light 1100 can include a rotatable ball head 1179 attached to the first clamp member 1110*a*. As with the ninth embodiment, and with reference to FIG. 48, the rotatable ball head 1179 can include a shaft 1171 projecting therefrom, for example, a cylindrical shaft. The lamp cover 1177*a*, 1177*b* can be attached to the shaft 1171, as will be described in more detail below.

Figure 46:
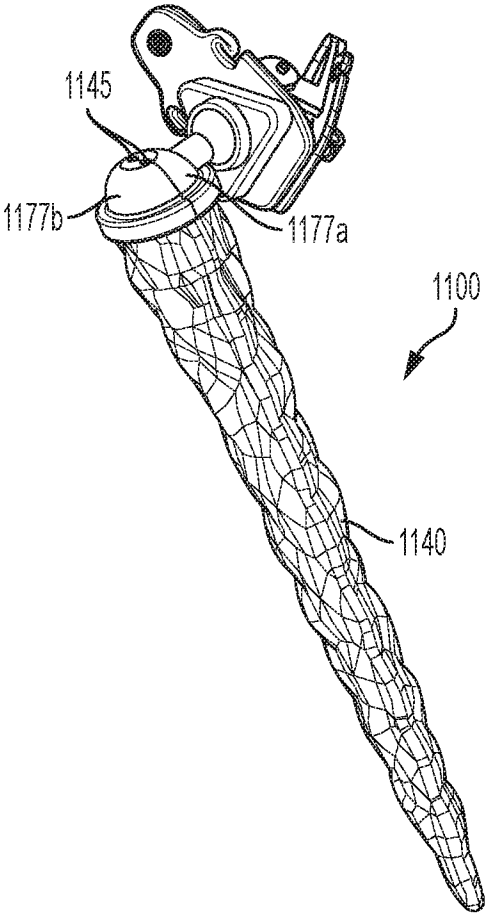
FIG. 46 depicts a top-left perspective view of FIG. 45.

FIG. 47B shows an exploded view of the lens 1140 and internal components. For example, an elongated circuit board 1199 can be connected to the wires 1128, 1129 (see FIG. 49). The circuit board 1199 can extend within the lens 1140. Internal circuitry 1120 and light units, such as LEDs 1122, can be provided on the circuit board 1199. The circuitry 1120 can control the operation of lights 1122. As shown in FIG. 46, the fixed lens cover 1177*a*, 1177*b* can define one or more holes 1145 for passage of the wires 1128, 1129, as shown in FIG. 49.

Figure 45:
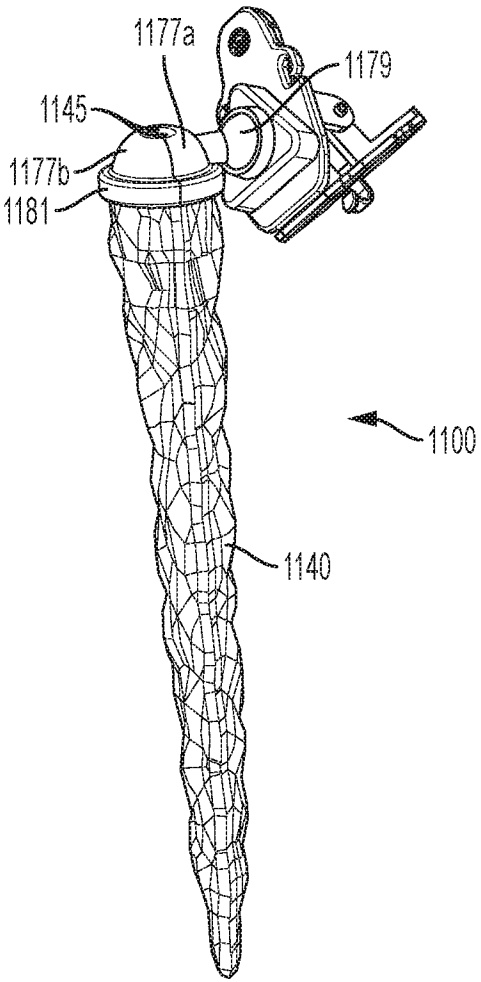
FIG. 45 depicts a perspective view of a clip light, according to the eleventh embodiment, shown with the light rotated into a different position than FIG. 44.
Figure 44:
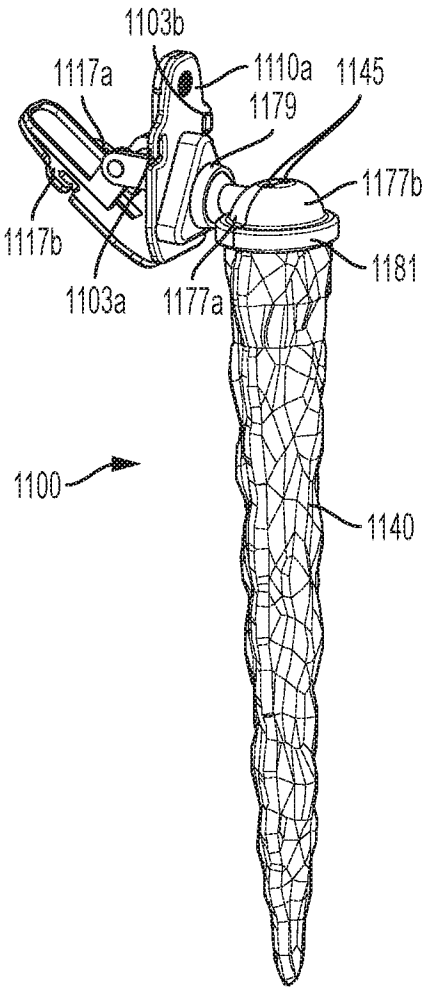
FIG. 44 depicts a perspective view of a clip light, according to an eleventh embodiment.

Referring to FIG. 48, the fixed lamp cover 1177*a*, 1177*b* can comprise a dome-shaped cap that attaches to the top of the lens 1140, for example, by having flange 1181 engage with a lip formed at the top of the lens 1140. However, one of ordinary skill in the art will appreciate based on this disclosure that other structures can be used to connect the fixed lamp cover 1177*a*, 1177*b* and the lens 1140. The fixed lamp cover 1177*a*, 1177*b* can comprise a multi-part cover having first and second portions 1177*a*, 1177*b* joined laterally to form the cover, however, other configurations are possible. In the embodiment shown, the connector body portion 1177*a* can define an interface in the form of a bore 1183 that receives and engages the shaft 1171, thereby joining the light unit 1175 to the ball head 1179 and the associated clip 1102. According to embodiments, the fixed lamp cover 1177*a*, 1177*b* can rotate about the axis of shaft 1171. Additionally, the ball head 1179 can rotate about multiple axes with respect to the clip 1102. This configuration allows the user to move and position the lamp 1140 in various positions with respect to the clip 1102. For example, FIGS. 45 and 46 show clip lights 1100 with the lens 1140 oriented in different directions from FIG. 44. As shown in FIGS. 44-49, the lens 1140 can comprise a transparent or translucent, cone-shaped member having multiple facets that resemble the shape of an icicle.

Figure 49:
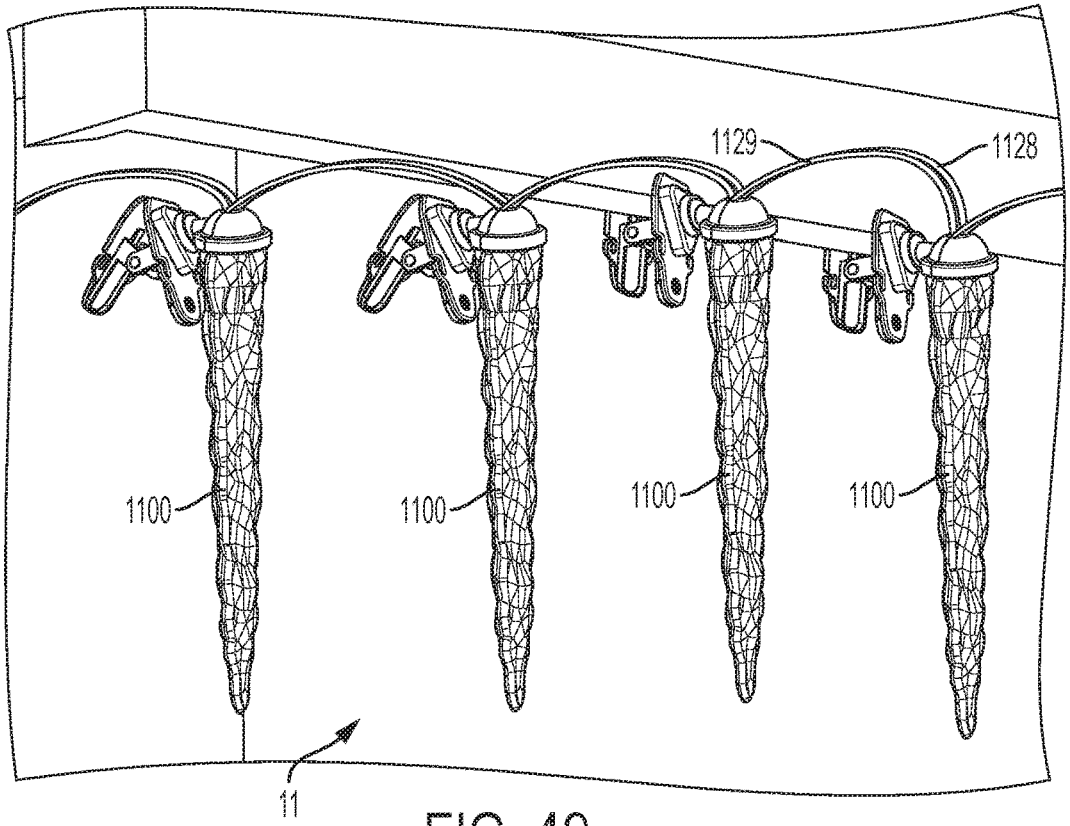
FIG. 49 depicts a perspective view of a string of clip lights being connected to an eaves, according to the eleventh embodiment.

FIG. 49 shows a lighting system 11 comprising a string of clip lights 1100 connected, for example, to a home. The clip lights 1100 can be connected together, for example, using wires 1128, 1129. The clip lights can be operated using similar structures and functions as described in connection with prior embodiments.

Twelfth Embodiment

Figure 50:
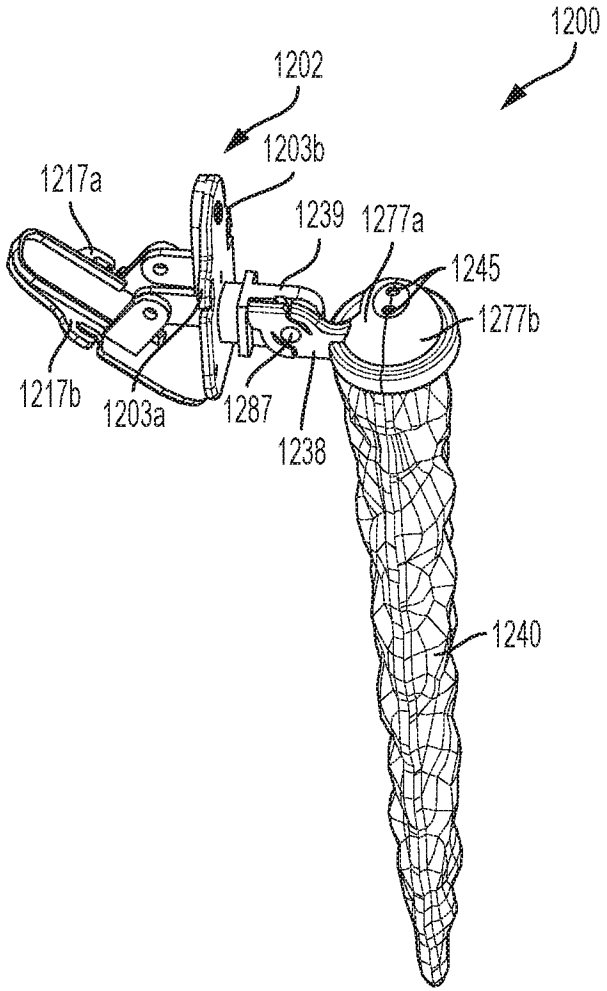
FIG. 50 depicts a perspective view of a clip light, according to a twelfth embodiment.

FIGS. 50-54 depict another embodiment of the present invention. FIG. 50 shows a perspective view of a clip light 1200 similar to the clip light 1000 of FIG. 38 except that the releasably engageable snap collar 938 and lens base 960 are replaced with a fixed lamp cover 1277*a*, 1277*b*, similar to the eleventh embodiment. Additionally, the lens 940 of the ninth embodiment is replaced with a lens 1240 similar to the eleventh embodiment, which, as shown, can be designed to resemble an icicle.

Figure 53:
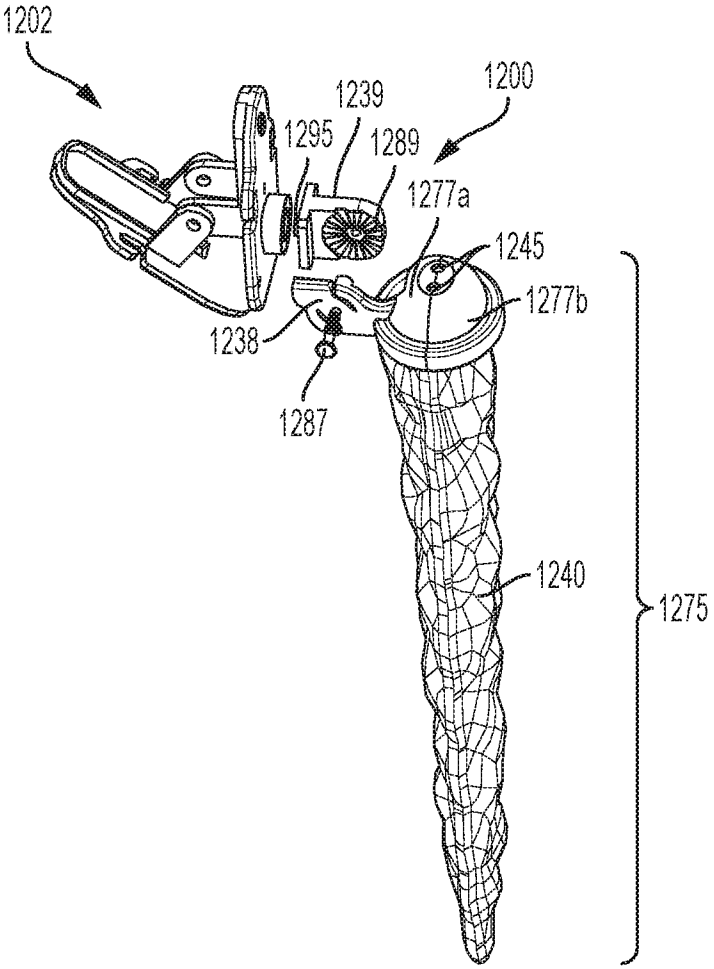
FIG. 53 depicts an exploded view of the clip light of FIG. 50.

As shown in FIG. 53, the fixed lamp cover portion 1277*a* can include a rotatable interface portion 1238 having a toothed engaging portion (hidden) that is complementary in shape to the engaging portion 1289 of the rotatable interface portion 1239. Similar to the description of the tenth embodiment, one of the engaging portions can be positioned in mating engagement with the other engaging portion and tightened by either a threaded fastener 1287, a spring-biased pin joint, or other structure known in the art. The ridges and valleys of the rotatable interface portions, when engaged, can prevent rotation of the two interfaces with respect to one another, thereby substantially fixing the angular position of the fixed lamp cover 1277*a*, 1277*b* (and attached lens 1240) with respect to the clip 1202.

Figure 51:
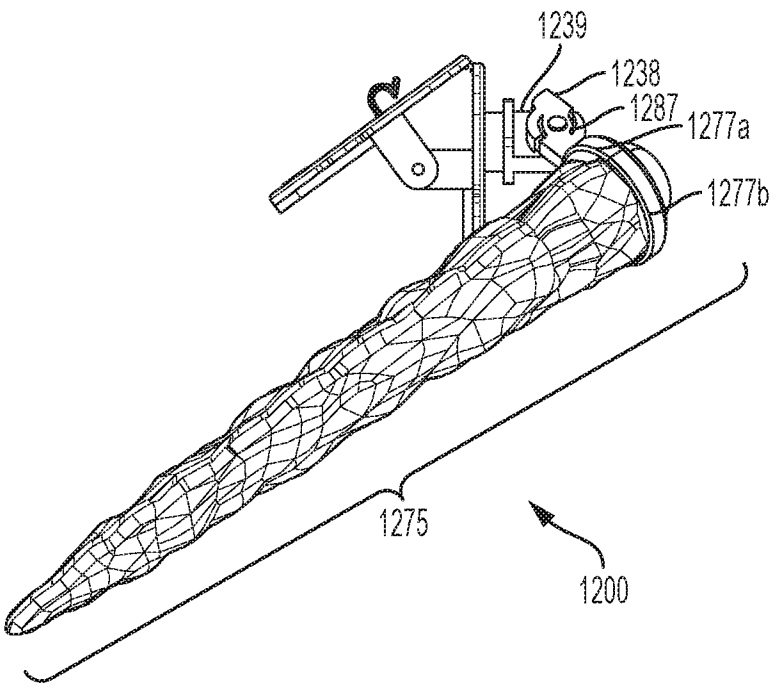
FIG. 51 depicts a side view of a clip light, according to the twelfth embodiment, shown with the light rotated to a different position than the light in FIG. 50.
Figure 52:
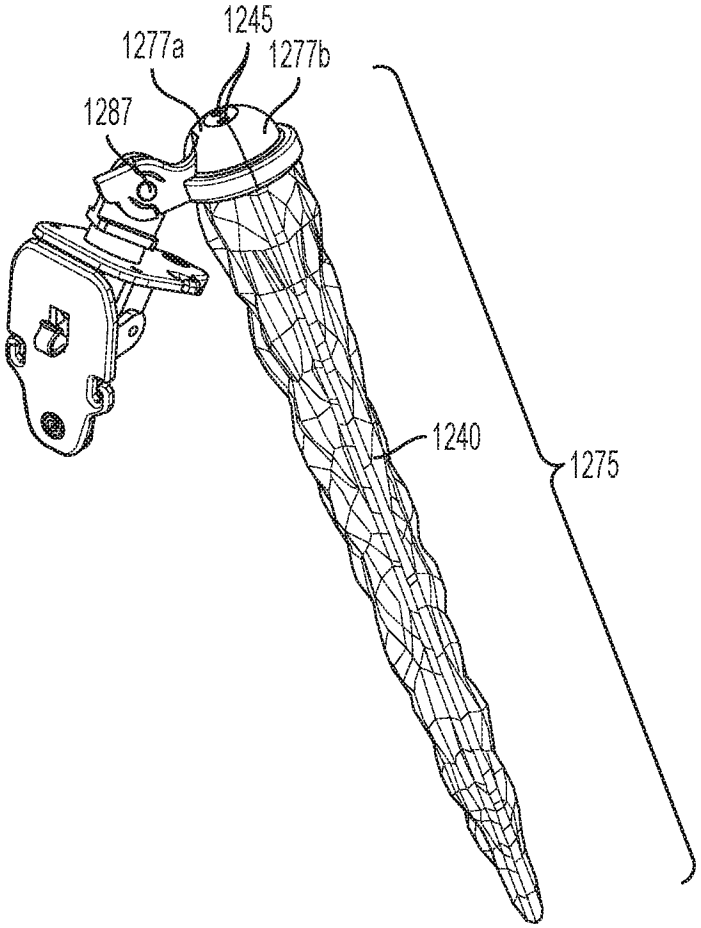
FIG. 52 depicts a perspective view of FIG. 51.

The light unit 1275 can rotate about at least two axes with respect to the clip 1202. For example, the rotatable interface portion 1239 can rotate about the axis of shaft 1295 (see FIG. 53) with respect to clip 1202. Additionally, the light unit 1275 (including lens 1240) can pivot with respect to clip 1202 about the threaded fastener 1287. For example, FIG. 50 shows the rotatable interface portion 1238 oriented straight out from the first clamp member 1210*a*. FIGS. 51 and 52 show the light unit 1275 after being rotated upward about the axis of the fastener 1287. Thus, FIGS. 51 and 52 show clip lights with the light unit 1275 oriented in a different direction than in FIG. 50.

Figure 54:
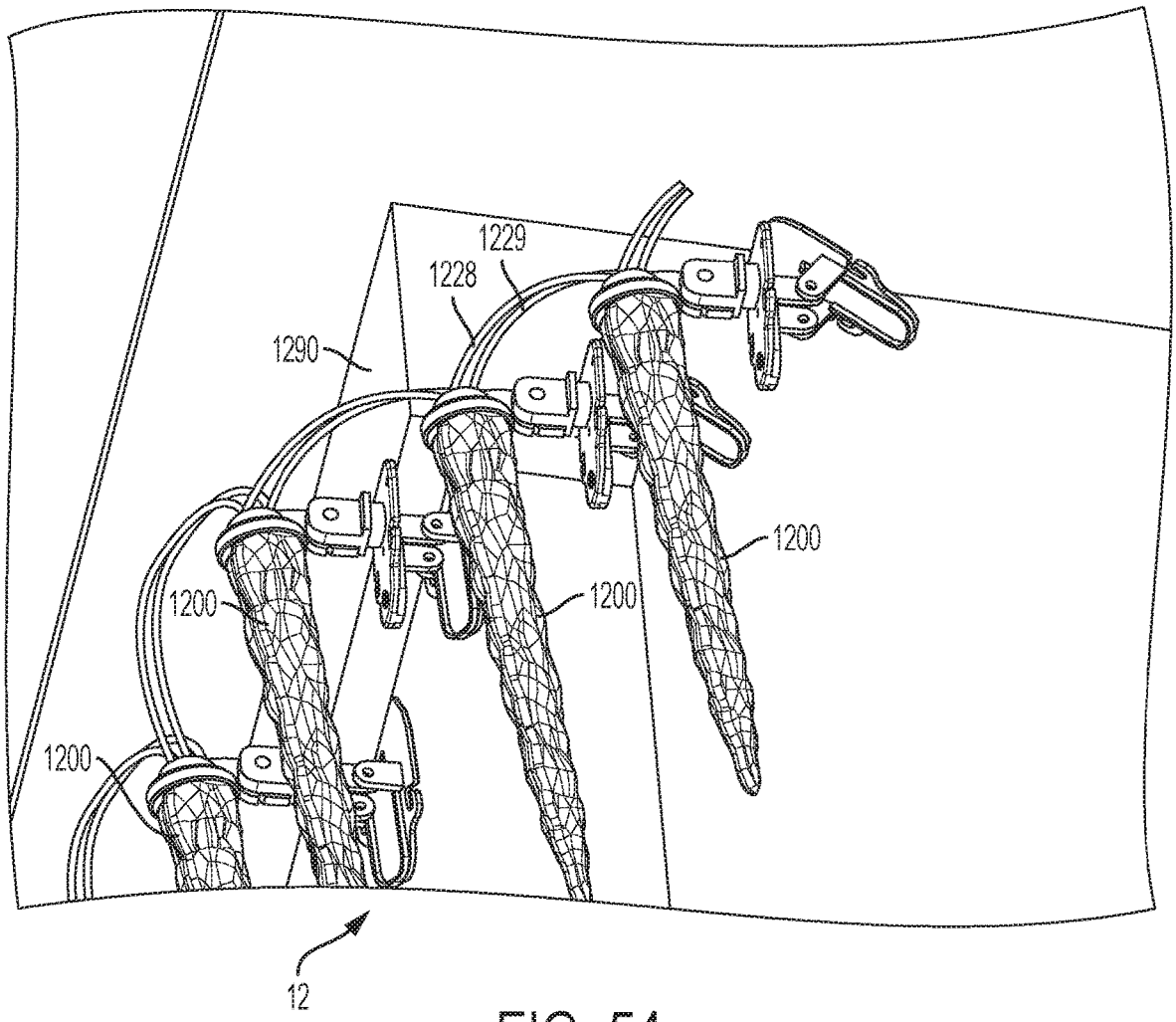
FIG. 54 depicts a perspective view of a string of clip lights, according to the twelfth embodiment.

As shown in FIG. 52, the fixed lamp cover 1277*a*, 1277*b* can define one or more holes 1245 for wires 1228, 1229 to proceed through, as shown in FIG. 54. The wires 1228, 1229 can connect to one or more lighting units inside lens 1240, for example, in a similar manner to what is shown in FIG. 47B.

FIG. 54 shows a system 12 comprising a string of clip lights 1200 attached to a structure 1290, such as an eave. As described above, one or more light units, such as LEDs, can be housed in each lens 1240 and connected to power and controls via the wires 1228, 1289. The clip lights can be operated using similar structures and functions as described in connection with prior embodiments.

Thirteenth Embodiment

Figure 55:
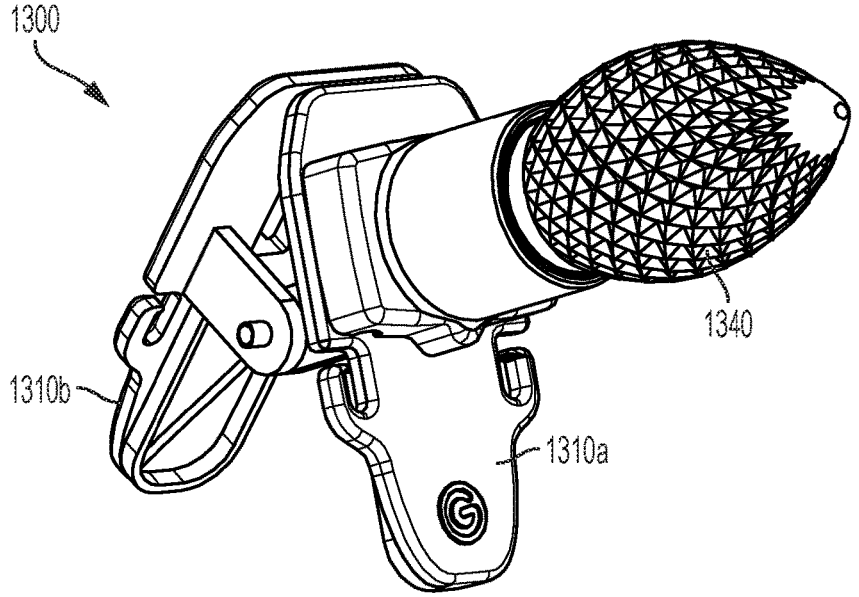
FIG. 55 depicts a perspective view of a clip light, according to a thirteenth embodiment.
Figure 56:
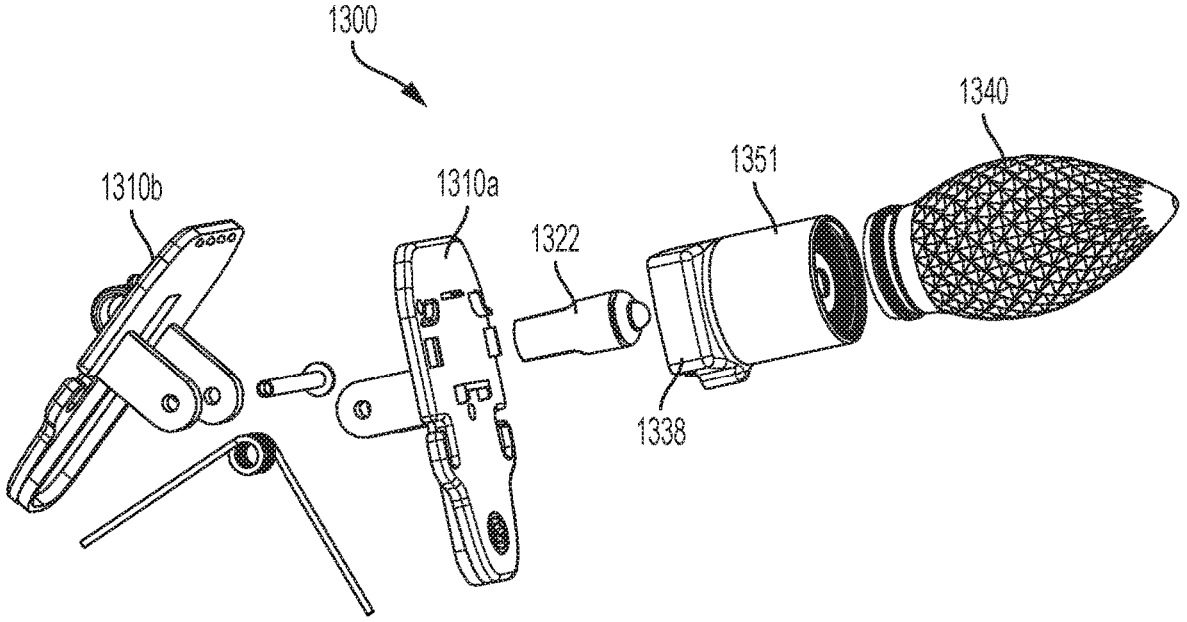
FIG. 56 depicts an exploded view of the clip light of FIG. 55.

FIGS. 55-59 depict a thirteenth embodiment of a clip light 1300 according to the present invention. FIG. 55 shows a perspective view of clip light 1300. Clip light 1300 can have first and second clamp members 1310*a*, 1310*b* that are connected together in the form of a hinge, and operate in a similar manner as previous embodiments. Lens 1340, such as a kaleidoscope lens, can illuminate the light from the clip light 1300. Clip light 1300 is similar to the clip light 600 of the sixth embodiment, except for differences described Here, the clip light 1300 can include a pluggable LED 1322 that is configured to stand upright inside the light unit covers 1338, 1351. The pluggable LED 1322 can be inserted into a lamp holder located on the clip 1302. Referring to FIG. 56, the light unit cover 1338 can be connected to the first clamp member 1310*a*, for example, using snap connectors, adhesives, or other structures known in the art. The cover 1338 can include a protruding receptacle 1351 that is configured to receive the LED 1322. In some embodiments, LED 1322 can be plugged into and through the protruding receptacle 1351. The lens 1340 can attach to the protruding receptacle 1351, for example, using mating threads. The protruding receptacle 1351 can distribute light to the lens 1340, which can comprise a beam splitting kaleidoscope lens. In some embodiments, the protruding receptacle 1351 is opaque, so as to prevent light transmission. As can be seen from FIG. 56, the lens 1340 can be an elongated, candle-shaped bulb having a plurality of light-diffracting facets.

Figure 57:
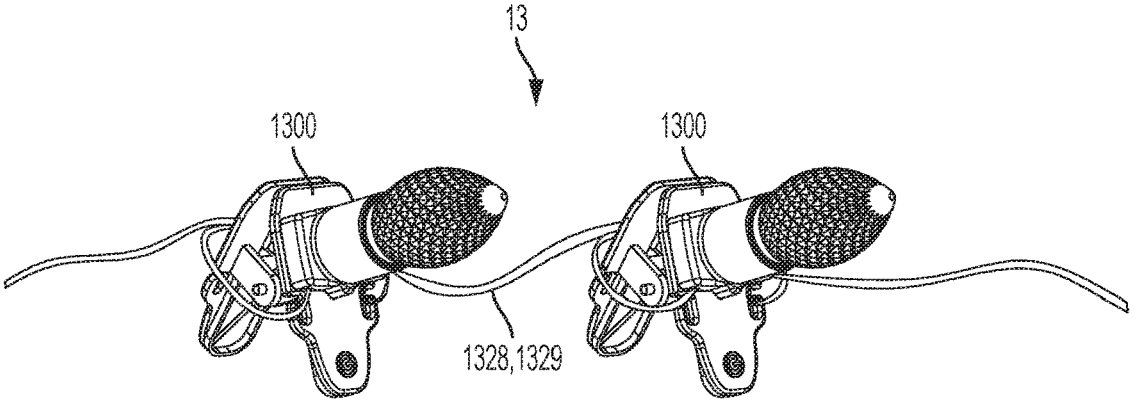
FIG. 57 depicts a perspective view of a string of clip lights, according to the thirteenth embodiment.
Figure 58:
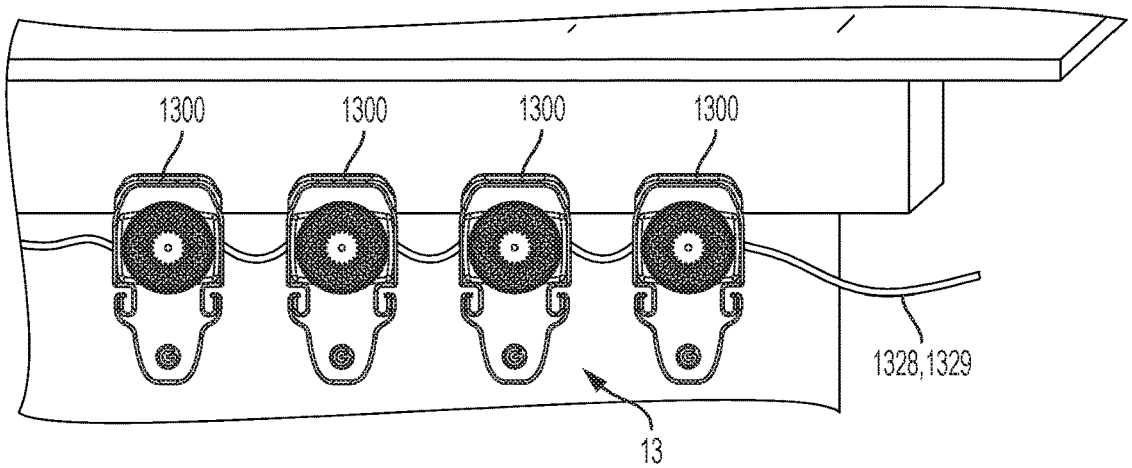
FIG. 58 depicts a front view of a string of clip lights connected to an eaves, according to the thirteenth embodiment.
Figure 59:
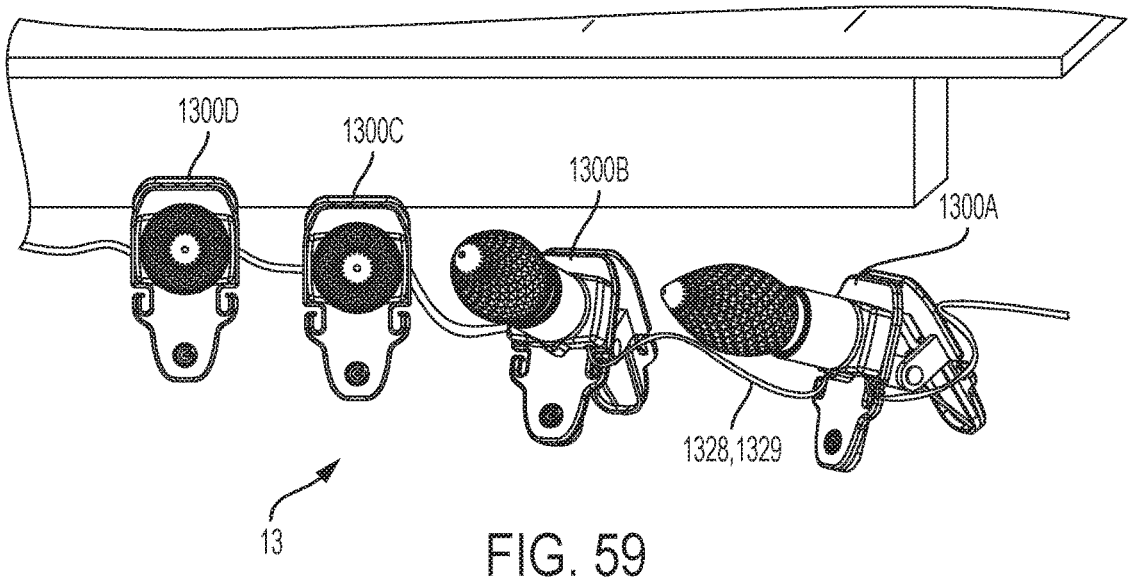
FIG. 59 depicts a perspective view of a string of clip lights being connected to an eaves, according to the thirteenth embodiment.

FIG. 57 shows a lighting system 13 including a chain of clip lights 1300 connected by one or more wires, 1328, 1329. The one or more wires 1328, 1329 can proceed in and out of cover 1338 in order to connect to the LED 1322, for example, by holes located in the cover. The wires can supply power and control of the LED 1322. FIG. 58 shows the chain of clip lights 1300 mounted to a structure 1390, such as a fascia board. FIG. 59 shows a progression of the state of the clip lights with clip lights 1300A and 1300B being in a relaxed, closed state, clip lights 1300C being in a more open, more expanded state, and clip light 1300D being in a mounted state.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A lighting system comprising:

a plurality of clip lights, arranged into a light string by wires, each of the plurality of clip lights having:

a clip having a first clamp member and a second clamp member that opposes the first clamp member, wherein the first clamp member and the second clamp member are elastically biased towards one another;

a housing mounted on the first clamp member, the housing defining a hole;

a light unit located in the housing;

a light unit cover housing the light unit, wherein the light unit cover is housed in the housing; and the light unit cover having a window, wherein the window covers the light unit and extends through the hole in the housing, wherein the window projects above a surface of the light unit cover.

2. The lighting system of claim 1, each of the plurality of clip lights further comprising an elastic member that biases the first clamp member towards the second clamp member.

3. The lighting system of claim 1, each of the plurality of clip lights further comprising a circuit board located within the housing.

4. The lighting system of claim 1, wherein the window comprises a lens, and the light unit projects light through the lens.

5. The lighting system of claim 4, wherein the lens comprises a beam-splitting kaleidoscope lens.

6. The ght lighting system of claim 1, wherein the light unit is capsule-shaped.

7. The lighting system of claim 1, wherein the light unit is surfaced mounted onto a printed circuit board.

8. The lighting system of claim 1, further comprising:

a power adapter that transmits power to the plurality of the clip lights through the wires; and a set of wires that connects the plurality of the clip lights to the power adapter.

9. The lighting system of claim 1, further comprising a controller that is connected to the light string and modulates power to the plurality of the clip lights.

10. The lighting system of claim 9, wherein the controller is part of the power adapter.

11. The lighting system of claim 9, wherein the controller communicates wirelessly with the power adapter.

12. The lighting system of claim 1, the window further comprising an outer perimeter, wherein the outer perimeter is located within the hole in the housing.

13. The lighting system of claim 1, wherein the light unit is a light emitting diode.

* * * * *